US008446330B1

(12) United States Patent
McCarville et al.

(10) Patent No.: US 8,446,330 B1
(45) Date of Patent: May 21, 2013

(54) ANTENNA FABRICATION

(75) Inventors: Douglas A. McCarville, Orting, WA (US); Joseph A. Marshall, Lake Forest Park, WA (US); Manny S. Urcia, Bellevue, WA (US); Otis F. Layton, Bonney Lake, WA (US)

(73) Assignee: The Boeing Company, Chicago, IL (US)

( * ) Notice: Subject to any disclaimer, the term of this patent is extended or adjusted under 35 U.S.C. 154(b) by 450 days.

(21) Appl. No.: 12/693,672

(22) Filed: Jan. 26, 2010

(51) Int. Cl.
*H01Q 21/26* (2006.01)

(52) U.S. Cl.
USPC ..... 343/797; 343/700 MS; 29/600; 29/592.1

(58) Field of Classification Search
USPC ..... 29/600, 592.1, 830–832; 343/700 MS, 343/795–797, 705
See application file for complete search history.

(56) References Cited

U.S. PATENT DOCUMENTS

| | | | | |
|---|---|---|---|---|
| 5,184,141 | A * | 2/1993 | Connolly et al. | 343/705 |
| 7,046,209 | B1 | 5/2006 | McCarville et al. | |
| 7,109,942 | B2 | 9/2006 | McCarville et al. | |
| 7,109,943 | B2 | 9/2006 | McCarville et al. | |
| 7,113,142 | B2 | 9/2006 | McCarville et al. | |
| 7,291,815 | B2 * | 11/2007 | Hubert et al. | 219/535 |
| 7,580,003 | B1 * | 8/2009 | Davis et al. | 343/872 |
| 2006/0097946 | A1 * | 5/2006 | McCarville et al. | 343/795 |

* cited by examiner

*Primary Examiner* — Minh Trinh
(74) *Attorney, Agent, or Firm* — Caven & Aghevli LLC

(57) ABSTRACT

In one embodiment a method to form a load bearing antenna aperture comprises forming a honeycomb core structure having a plurality of wall sections, the wall sections including electromagnetic radiating elements, and wherein lower surfaces of the wall sections defines a first surface and upper surfaces of the wall sections define a second surface, positioning a back skin to the first surface of the honeycomb core structure with an adhesive layer which comprises a layer of adhesive film and a paste adhesive disposed on the layer of adhesive film. Other embodiments are disclosed.

15 Claims, 33 Drawing Sheets

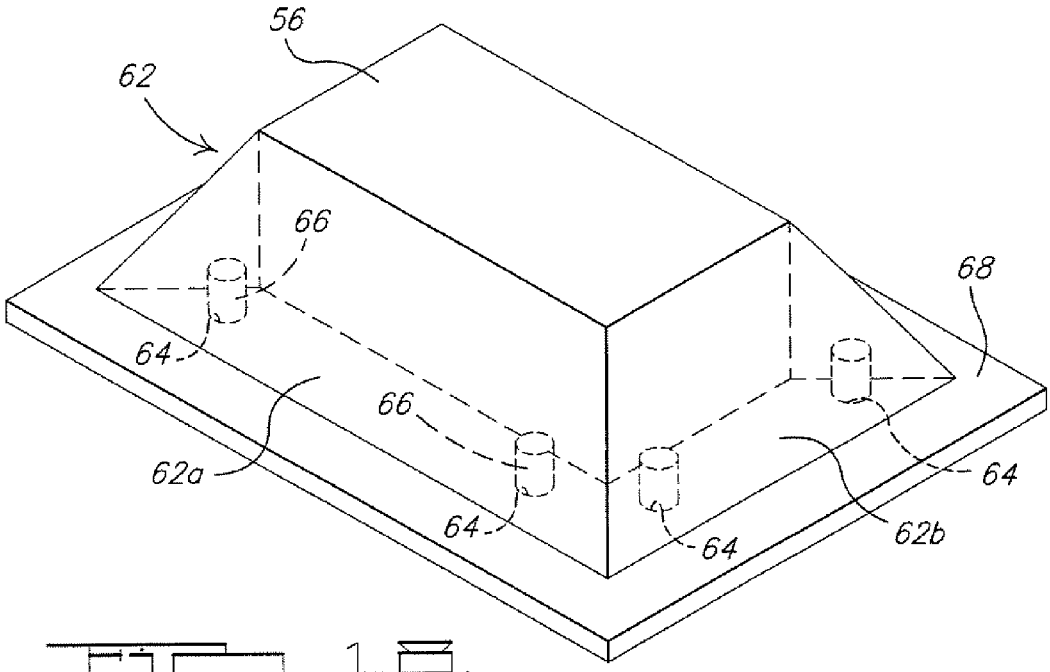
FIG. 18.
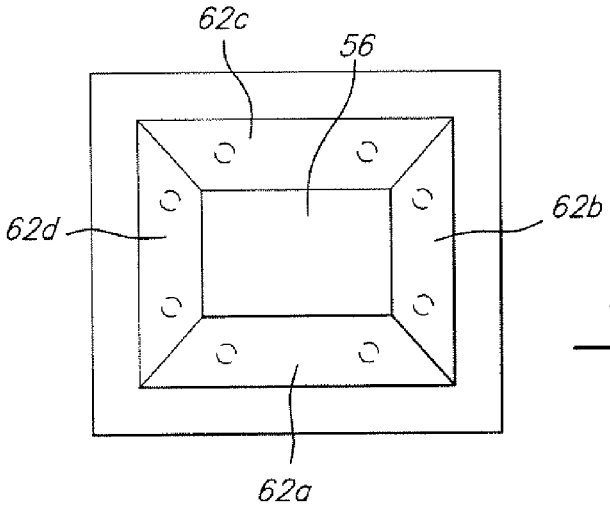
FIG. 19.
FIG. 20.
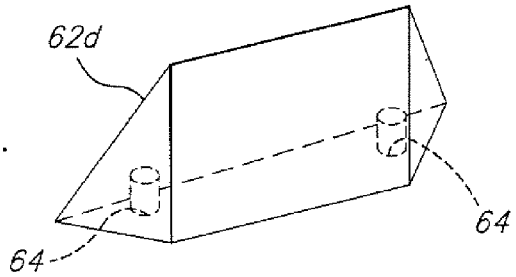

| | Shear | Flatwise | Bending | Compression |
|---|---|---|---|---|
| For Antenna 10 Honeycomb Like Core Of 11.7 Lbs./Sq. Ft. | 557 lb | 698 lb | 1015 lb | 3100 lb |
| Conventional 12 Lbs./Sq. Ft. HRP® Core | 531 lb | 625 lb | 1000 lb | 2080 lb |

ANTENNA FABRICATION

BACKGROUND

The subject matter described herein relates to antenna systems. More particularly, the disclosure relates to antenna systems which can be used as a structural, load-bearing portion of a mobile platform and constructed to match an outer mold line of the area of the mobile platform into which the antenna system is integrated.

Present day mobile platforms, such as aircraft (manned and unmanned), spacecraft and even land vehicles, often require the use of an antenna aperture for transmitting and receiving electromagnetic wave signals. The antenna aperture is often provided in the form of a phased array antenna aperture having a plurality of antenna elements arranged in an X-Y grid-like arrangement on the mobile platform. The various components on which the radiating elements of the antenna are mounted add weight to the mobile platform. Often these components comprise aluminum blocks or other like substructures that add "parasitic" weight to the overall antenna aperture, but otherwise perform no function other than as a support structure for a portion of the antenna aperture. By the term "parasitic" it is meant weight that is associated with components of the antenna that are not directly necessary for transmitting or receiving operations.

An antenna array that is able to form a load bearing structure for a portion of a mobile platform would provide important advantages. For example, the number and nature of sensor functions capable of being implemented on the mobile platform could be increased significantly over conventional electronic antenna and sensor systems that require physical space within the mobile platform. Integrating the antenna into the structure of the mobile platform also eliminates less than desired effects on aerodynamics that may result when an antenna aperture is mounted on an exterior surface of a mobile platform. This could also eliminate the parasitic weight that would otherwise be present if the antenna aperture was formed as a distinct, independent component that required mounting on an interior or exterior surface of the mobile platform.

Thus, structural, load-bearing antenna arrays and methods to make the same may be desirable in aerospace applications and other communication applications.

SUMMARY

The subject matter described herein is directed to an antenna aperture having a construction making it suitable to be integrated as a structural, load bearing portion of the greater structure. In one embodiment the antenna aperture is constructed to form a load bearing portion of a mobile platform, and more particularly a portion of a wing, fuselage or door of an airborne mobile platform.

In some embodiments the antenna aperture forms a grid of antenna elements that can be manufactured, and scaled, to suit a variety of antenna and/or sensor applications. In one embodiment the antenna aperture comprises a honeycomb-like structure having a grid-like arrangement of dipole radiating elements. The antenna aperture does not require any metallic, parasitic supporting structures that would ordinarily be employed as support substrates for the radiating elements, and thus avoids the parasitic weight that such components typically add to an antenna In various aspects, methods to form a load bearing antenna aperture and resulting apertures are disclosed. Thus, in one aspect there is provided a method to form a load bearing antenna aperture. In one embodiment the method comprises forming a honeycomb core structure having a plurality of wall sections, the wall sections including electromagnetic radiating elements. The lower surfaces of the wall sections define a first surface and upper surfaces of the wall sections define a second surface. The method further comprises securing a back skin to the first surface of the honeycomb core structure with an adhesive layer which comprises a layer of adhesive film and a paste adhesive disposed on the layer of adhesive film.

In another aspect there is provided a method to form a load bearing antenna aperture. In one embodiment the method comprises forming a honeycomb core structure having a plurality of wall sections. The wall sections include electromagnetic radiating elements, wherein lower surfaces of the wall sections define a first surface and upper surfaces of the wall sections define a second surface. The method further comprises depositing an adhesive layer on at least one of the first surface or the second surface, securing a back skin to the first surface of the honeycomb core structure, positioning a first honeycomb tool into the honeycomb core structure, positioning a second honeycomb tool into the first honeycomb tool to form an antenna aperture assembly, and curing the antenna aperture assembly In yet another aspect there is provided a load bearing antenna aperture assembly. In one embodiment, the antenna aperture assembly comprises a honeycomb core structure having a plurality of wall sections, the wall sections including electromagnetic radiating elements, wherein lower surfaces of the wall sections define a first surface and upper surfaces of the wall sections define a second surface. The antenna aperture assembly further comprises a first adhesive pack disposed on the first surface, wherein the adhesive pack comprises a first layer of adhesive film, a second layer opposite the first layer of adhesive film, and a paste adhesive disposed between the first layer and the second layer. The assembly further comprises a back skin disposed on to the first surface of the honeycomb core structure by the first adhesive pack, and an antenna electronics board disposed adjacent at least a portion of the back skin. The electronics board comprises a plurality of antenna feed elements arranged in a predetermined pattern. The first layer of adhesive film comprises a plurality of rebates formed in a predetermined pattern corresponding to the predetermined pattern of antenna feed elements.

The features, functions and advantages discussed herein can be achieved independently in various embodiments described herein or may be combined in yet other embodiments, further details of which can be seen with reference to the following description and drawings.

BRIEF DESCRIPTION OF THE DRAWINGS

The detailed description is described with reference to the accompanying figures.

FIG. 18 is an illustration of a perspective view of the subassembly of FIG. 16 placed within a compaction tool 62 for compacting;

FIG. 19 is an illustration of a top view of the assembly of FIG. 18;

FIG. 20 is an illustration of a perspective view of one of the sections of the tool shown in FIG. 18;

DETAILED DESCRIPTION

The following description of the preferred embodiment(s) is merely exemplary in nature and is in no way intended to limit the scope of the claims, its application, or uses.

Figure 1:
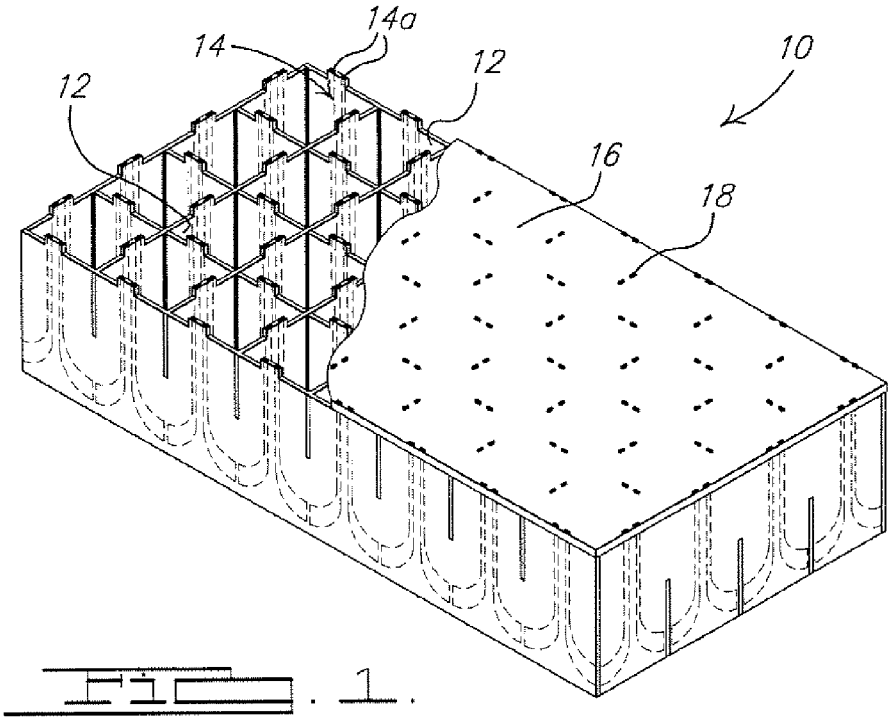
FIG. 1 is an illustration of a perspective view of an antenna aperture in accordance with embodiments.

Referring to FIG. 1, there is shown an antenna aperture 10 in accordance with an embodiment. The antenna aperture 10 essentially forms a load bearing honeycomb-like structure that can be readily integrated into composite structural portions of mobile platforms without an undesirable change in the overall strength of the structural portion. Further, the antenna aperture does not add significant additional weight beyond what would be present with a conventional honeycomb core, sandwich-like construction technique that does not incorporate an antenna capability.

The aperture 10 includes a plurality of wall sections 12 interconnected to form a honeycomb or grid-like core section. Each wall section 12 includes a plurality of electromagnetic radiating elements 14 embedded therein. While FIG. 1 illustrates an X-Y grid-like (i.e., honeycomb-like) arrangement presenting generally square shaped openings, other grid arrangements are possible. For example, a honeycomb or grid-like core structure having hexagonally shaped openings can also be formed. Accordingly, the substantially perpendicular layout of the wall sections 12 that form antenna aperture 10 is intended merely to show one preferred grid-like layout for the radiating elements 14. The type of grid selected and the overall size of the antenna aperture 10 will depend on the needs of a particular application with which the aperture 10 is to be used.

The preferred antenna aperture 10 does not require the use of metallic substrates for supporting the radiating elements 14. The antenna aperture 10 therefore may not have an undesirable parasitic weight penalty. The antenna aperture 10 is a lightweight structure making it especially well suited for aerospace applications.

The preferred aperture 10 provides sufficient structural strength to be capable of replacing a load bearing structure. For example, in mobile platform applications, the antenna aperture 10 can be used as a primary structural component in an aircraft, spacecraft or rotorcraft. Other possible applications may be with ships or land vehicles. Since the antenna aperture 10 can be integrated into the structure of the mobile platform, it may not negatively impact the aerodynamics of the mobile platform as much as would be the case with an antenna aperture that is required to be mounted on an external surface of an otherwise highly aerodynamic, high speed mobile platform.

With further reference to FIG. 1, the antenna aperture 10 further includes a back skin 16, a portion of which has been cut away to better reveal the grid-like arrangement of wall sections 12. The back skin 16 has openings 18 which allow "teeth" 14*a* of each electromagnetic radiating component 14 to project to better enable electrical connection of the radiating elements 14 with other electronic components.

Construction of Wall Sections

Figure 2:
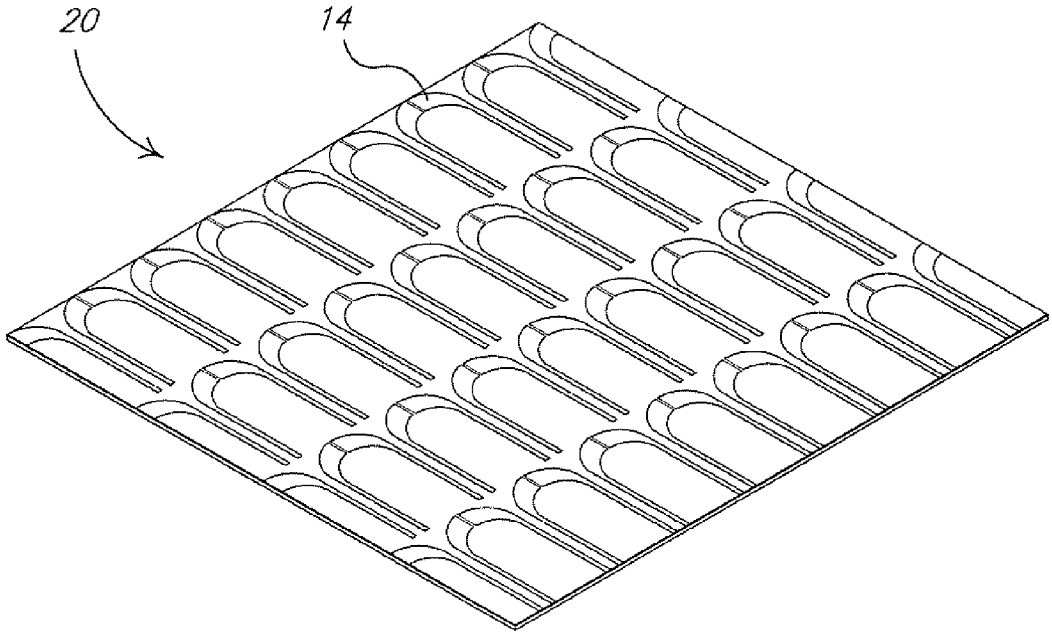
FIG. 2 is an illustration of a perspective view of a material sheet having a plurality of electromagnetic radiating elements.

Referring now to FIG. 2, a substrate layer 20 is formed with a plurality of the radiating elements 14 on its surface with the elements 14 being formed, for example, in parallel rows on the substrate 20. In one preferred form the substrate 20 comprises a sheet of Kapton® polyimide film having a thickness of preferably about 0.0005-0.003 inch (0.0127 mm-0.0762 mm) The Kapton® film substrate 20 is coated with a copper foil that is then etched away to form the radiating elements 14 so that the elements 14 have a desired dimension and relative spacing. Other structures or arrangements are possible.

Figure 3:
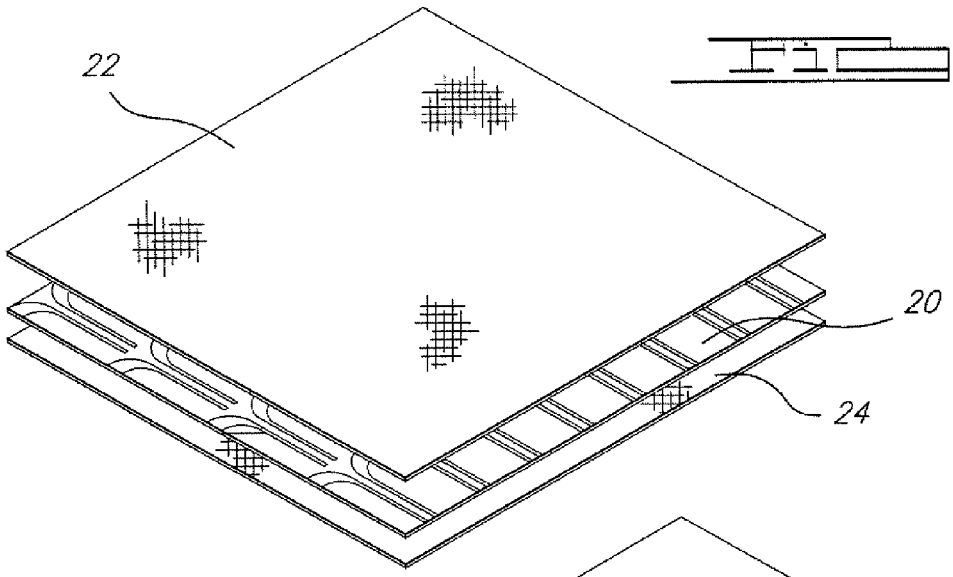
FIG. 3 is an illustration of a perspective view of a pair of fabric prepreg plies positioned on opposite sides of the material sheet of FIG. 2, ready to be bonded together to sandwich the material sheet.

In FIG. 3, the substrate 20 is placed between two layers of resin rich impregnated fabric 22 and 24 and then cured flat in an oven or autoclave, typically for a period of 2-6 hours. The impregnated fabric 22 for example without limitation comprises Astroquartz® fibers preimpregnated with Cyanate Ester resin to provide the desired electrical properties, especially dielectric and loss tangent properties. Other composite materials may also be used, such as fiberglass with epoxy resin.

Figure 4:
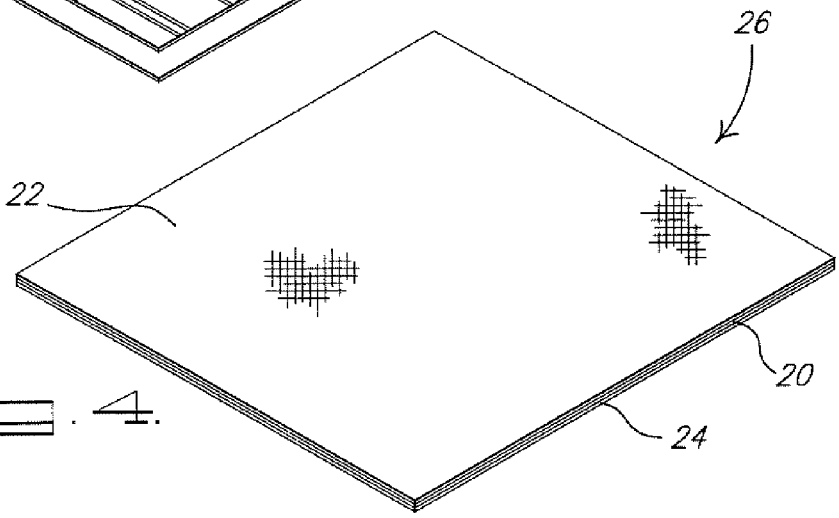
FIG. 4 is an illustration of a perspective view of the subassembly of FIG. 3 after bonding.
Figure 5:
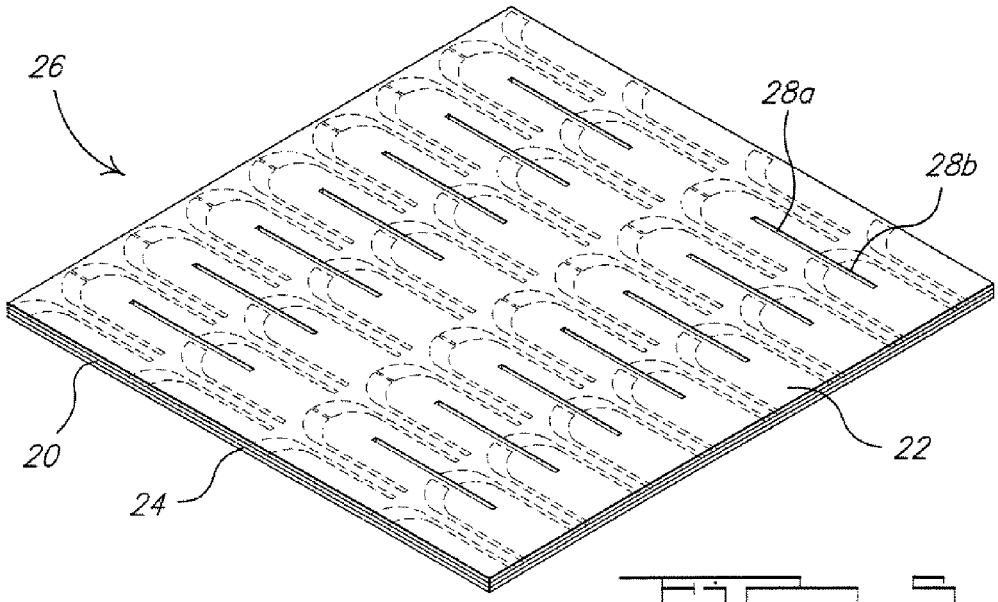
FIG. 5 is an illustration of a perspective view of the assembly of FIG. 4 showing the slots that are cut to enable subsequent, interlocking assembly of wall portions of the antenna aperture.

As shown in FIG. 4, the component 26 forms a lightweight yet structurally rigid sheet with the radiating elements 14 sandwiched between the two impregnated fabric layers 22 and 24. Referring to FIG. 5, assembly slots 28 having portions 28*a* and 28*b* are then cut into the component 26 at spaced apart locations. Slots 28 facilitate intersecting assembly of the wall portions 12 (FIG. 1). Slots 28 are for example and without limitation preferably water jet cut or machine routed into the component 26 to penetrate through the entire thickness of the component 26. Making the component 26 in large flat sheets may allow a manufacturer to take advantage of precision, high rate manufacturing techniques involving copper deposition, silk screening, etc. Further, by including features in the flat component 26 such as the slots 28 and the radiating elements 14, one can insure very precise placement and repeatability of the radiating elements, which in turn allows coupling to external electronics with a high degree of precision.

Figure 6:
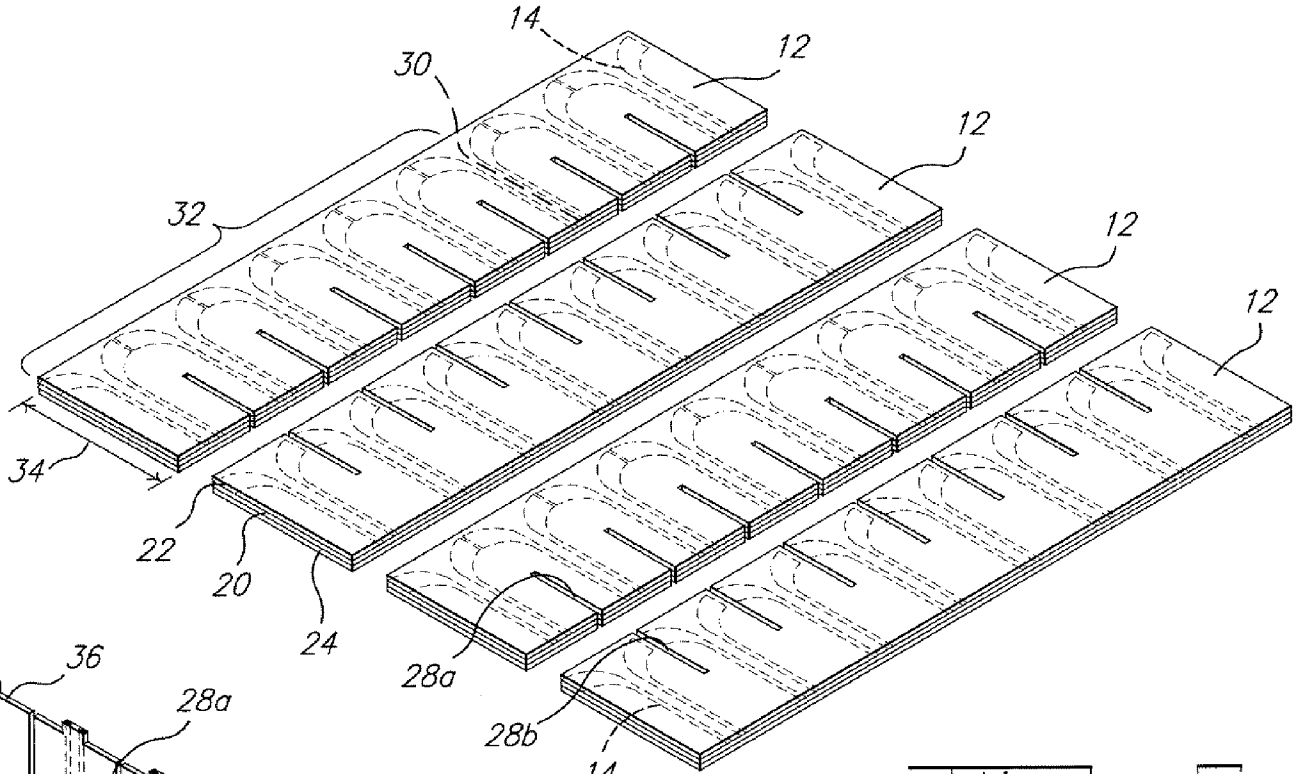
FIG. 6 is an illustration of a view of the assembly of FIG. 5 with the assembly cut into a plurality of sections to be used as wall sections for the antenna aperture.

Referring to FIG. 6, the component 26 is then cut into a plurality of sections that form wall portions 12. If the antenna aperture 10 will be substantially rectangular in shape, rather than square, then an additional cut will be made to shorten the length of those wall portions 12 that will form the short side portions of the aperture 10. For example, a cut may be made along dash line 30 so that the resultant length 32 may be used to form one of the two shorter sides of the aperture 10 of FIG. 1. Distance 34 represents the overall height that the antenna aperture 10 will have. The wall sections 12 may also be planed to a specific desired thickness. In one preferred implementation, a thickness of between about 0.015 inch-0.04 inch (0.381 mm-1.016 mm) for the wall sections 12 is preferred.

Figure 7:
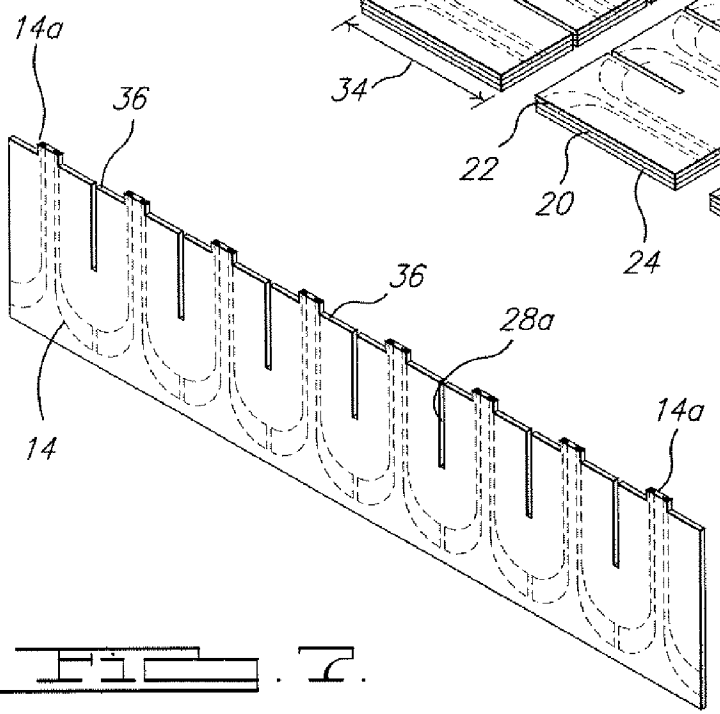
FIG. 7 illustrates the notches that are cut along one edge of each wall section to form teeth at a terminal end of each radiating element.

Referring to FIG. 7, an edge of each wall section may be cut to form notches 36 between terminal ends of each radiating element 14. The notches 36 enable the terminal ends of each radiating element 14 to form the teeth 14*a* (also illustrated in FIG. 1). However, the formation of teeth 14*a* is optional.

Assembly of Wall Sections

Figure 8:
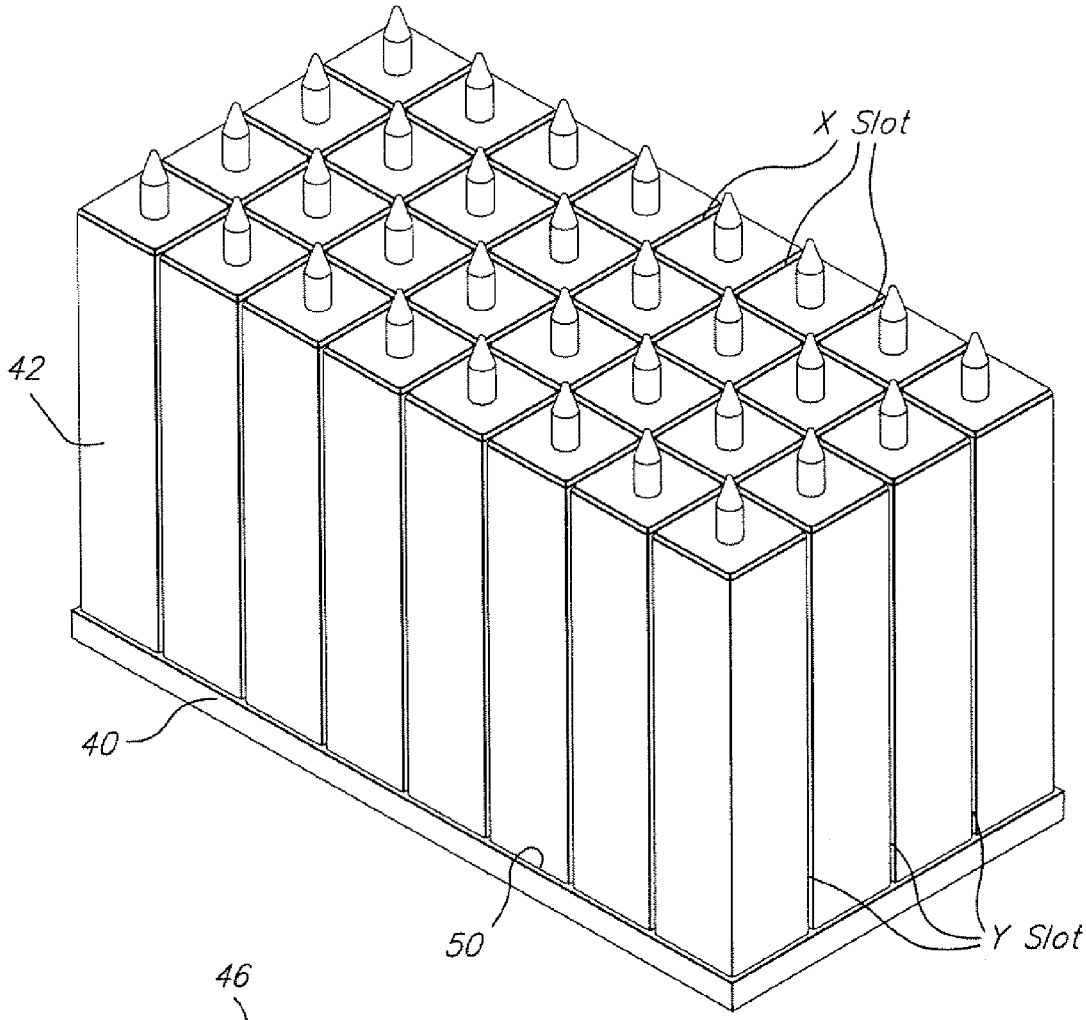
FIG. 8 is an illustration of a view of a tool used to align the wall sections of the aperture during an assembly process.

Referring to FIG. 8, a tool that is used to support the wall sections 12 during forming of the aperture 10 is shown. The tool 38 comprises a base 40 that is used to support a plurality of blocks 42 in an orientation to form a plurality of perpendicularly extending slots 28. For convenience, one group of slots 28 has been designated as the "X-direction" slots 28 and one group as the "Y-direction" slots 28.

Figure 9:
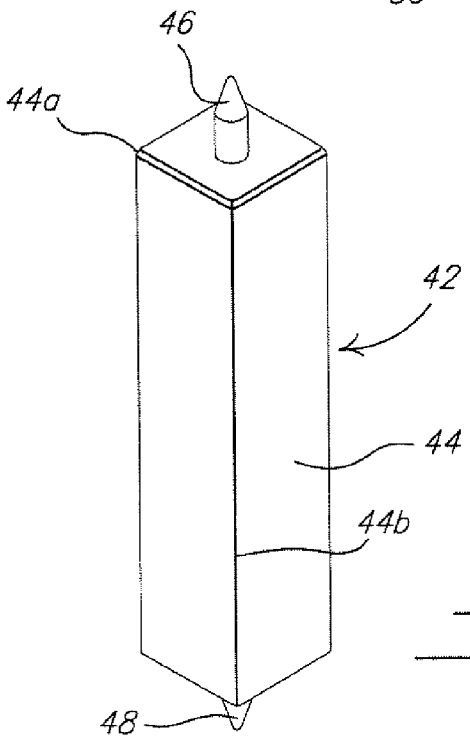
FIG. 9 is an illustration of a perspective view of one metallic block shown in FIG. 8.

Referring to FIG. 9, one of the blocks 42 is shown in greater detail. Block 42 includes a main body 44 that is generally square in cross sectional shape. Upper and lower locating pins 46 and 48, respectively, are located at an axial center of the main body 44. Each block 42 is preferably formed from aluminum but may be formed from other metallic materials as well. The main body 44 of each metallic block 42 further preferably has radiused upper corners 44*a* and radiused longitudinal corners 44*b*. The metallic blocks 42 also preferably include a polished outer surface.

Figure 10:
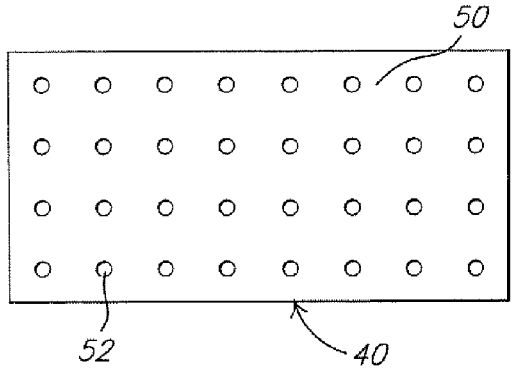
FIG. 10 is an illustration of a plan view of the lower surface of a top plate that is removably secured to each of the mounting blocks of FIG. 8 during the assembly process.

With brief reference to FIG. 10, an upper surface 50 of the base plate 40 is shown. The upper surface 50 includes a plurality of precisely located recesses 52 for receiving each of the lower locating pins 48 of each metallic block 42. The recesses 52 serve to hold the metallic blocks 42 in a spaced apart alignment that forms the X-direction slots 28 and the Y-direction slots 28.

Figure 11:
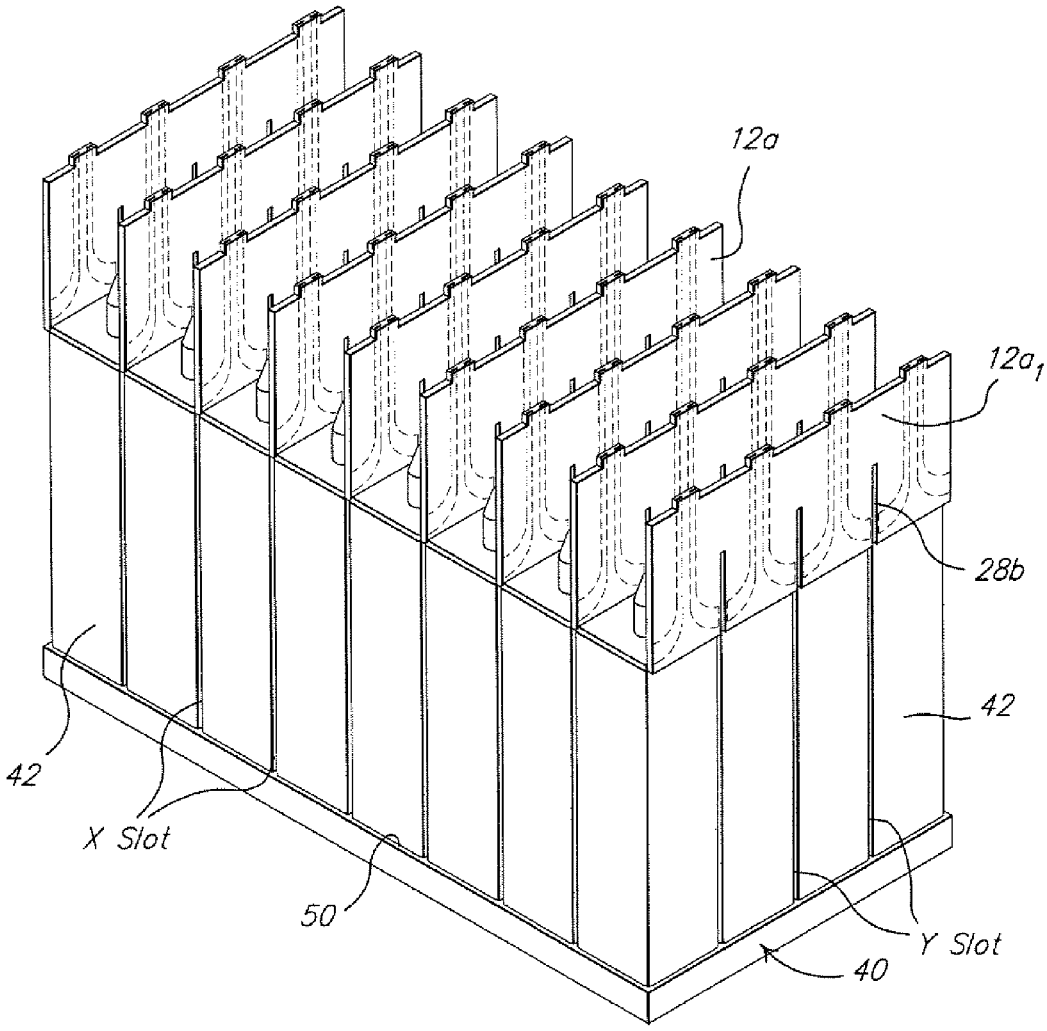
FIG. 11 is an illustration of a perspective view illustrating a plurality of wall sections being inserted in X-direction slots formed by the tool.
Figure 12:
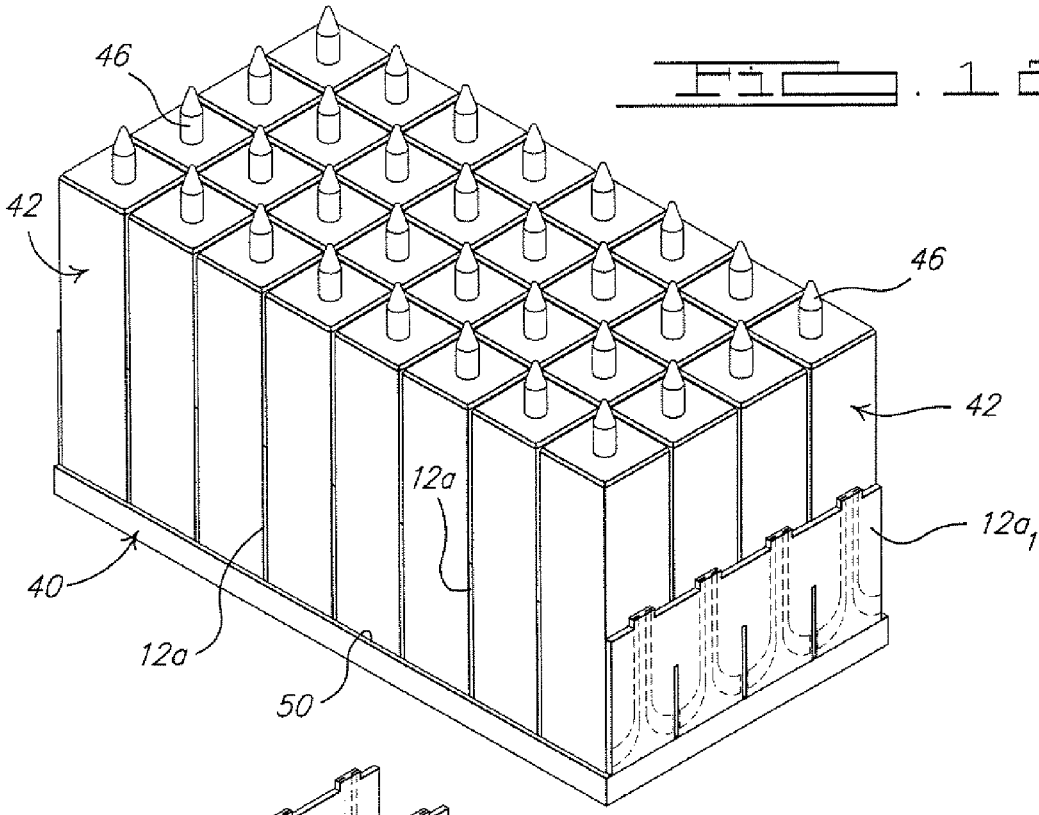
FIG. 12 is an illustration which shows the wall sections of FIG. 11 fully inserted into the tool, along with a pair of outer perimeter wall sections being temporarily secured to perimeter portions of the tool.

Referring to FIG. 11, a first subplurality of the wall sections that will form the X-direction walls of the aperture 10 are inserted into the X-direction slots 28. For convenience, these wall sections will be noted with reference numeral 12*a*. Each of the wall sections 12*a* include slots 28*b* and are inserted such that slots 28*b* will be adjacent the upper surface 50 of the base plate 40 once fully inserted into the X-direction slots 28. Outermost wall sections $\mathbf{12}a_1$ may be temporarily held to longitudinal sides of the metallic blocks 42 by for example without limitation Mylar® PET film or Teflon® PTFE tape. FIG. 12 shows each of the wall sections 12*a* seated within the X-direction slots 28 and resting on the upper surface 50 of the base plate 40.

Figure 13:
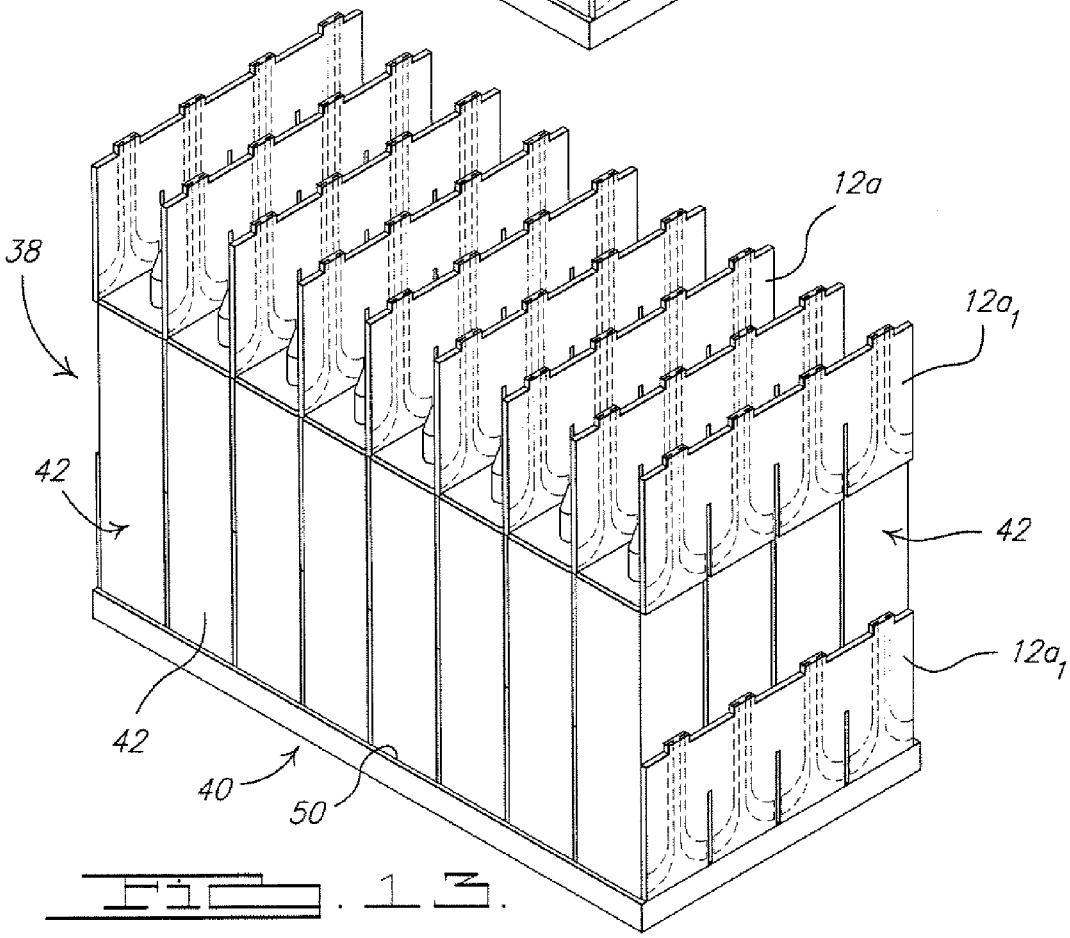
FIG. 13 is an illustration which illustrates a second plurality of wall sections being inserted into the X-direction rows of the tool.
Figure 14:
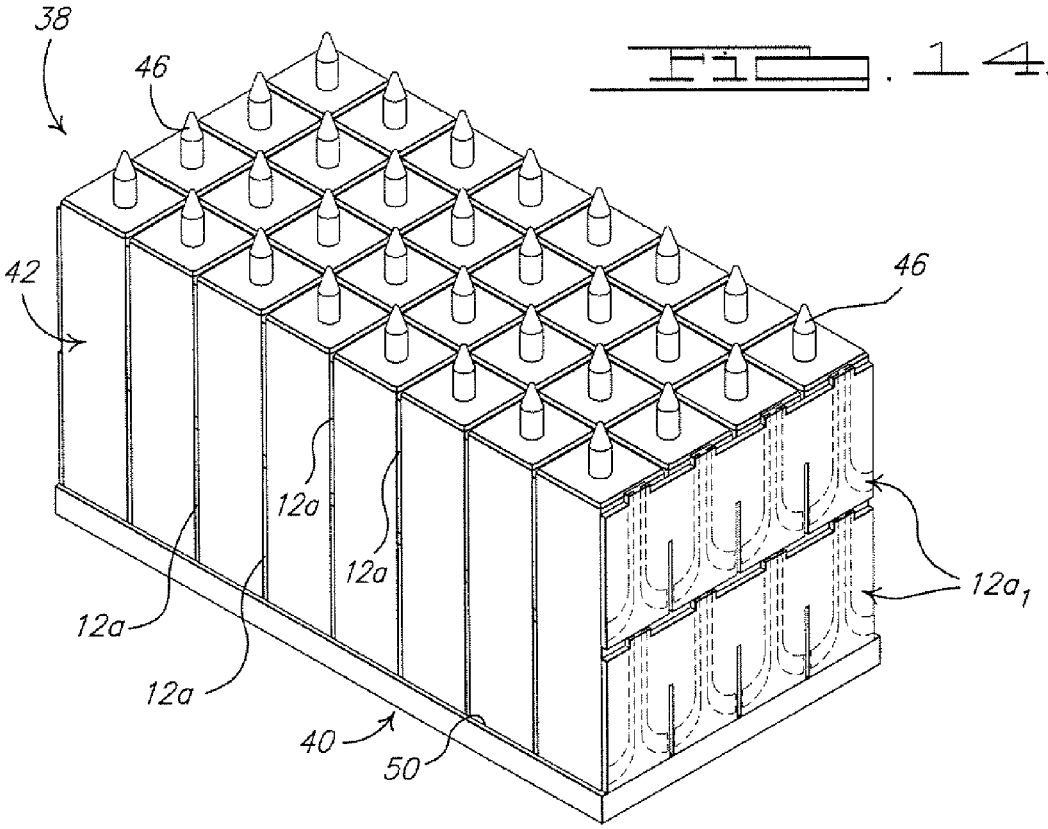
FIG. 14 is an illustration which illustrates the second plurality of wall sections fully inserted into the tool.

Referring to FIG. 13, a second vertical layer of wall sections 12*a* may then be inserted into the X-direction slots 28. A second subplurality of wall sections $\mathbf{12}a_1$ are similarly secured along the short sides of the tool 38. The second plurality of wall sections 12*a* rest on the first plurality. FIG. 14 shows the second subplurality of wall sections 12*a* fully inserted into the X-direction slots 28.

Figure 15:
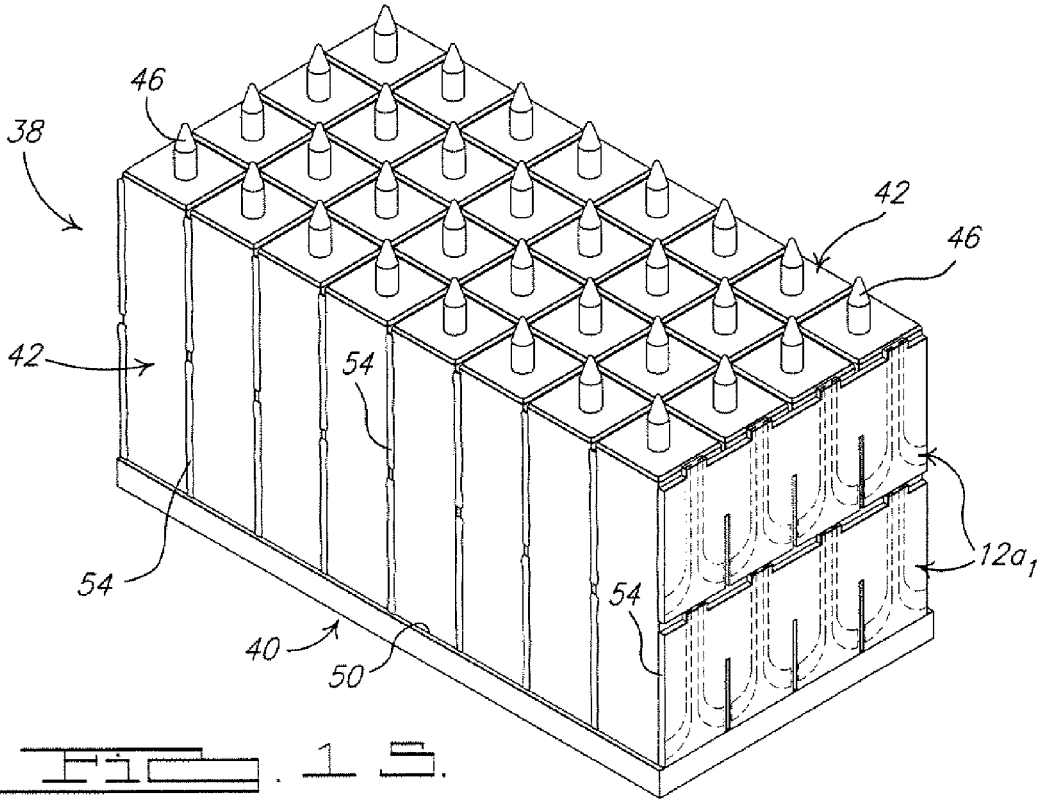
FIG. 15 is an illustration which illustrates areas where adhesive is applied to edge portions of the wall sections.
Figure 16:
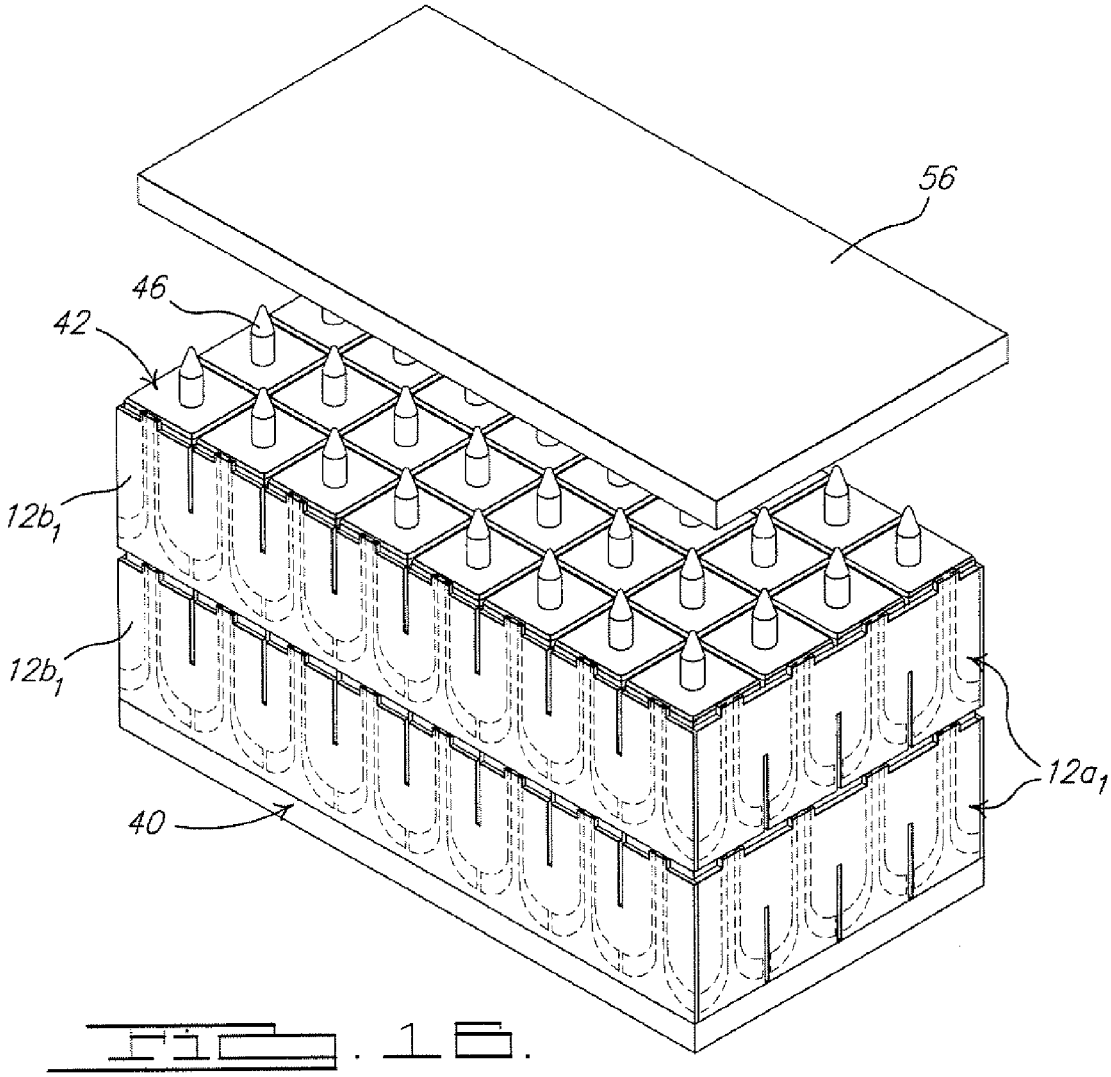
FIG. 16 is an illustration which illustrates additional wall sections secured to the long, perimeter sides of the tool, together with a top plate ready to be secured over the locating pins of the metallic blocks.
Figure 17:
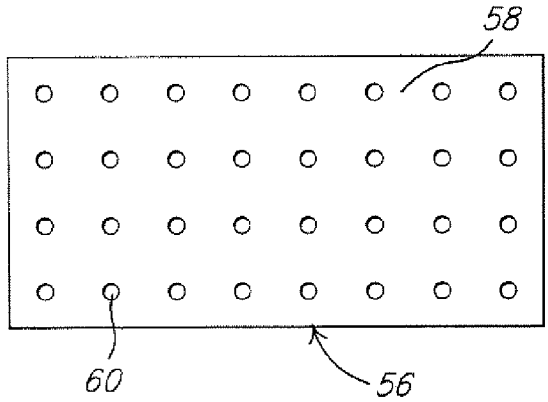
FIG. 17 is an illustration of a view of the lower surface of the top plate showing the recesses therein for receiving the locating pins of each metallic block.

Referring to FIG. 15, beads of adhesive 54 are placed along edges of each of wall sections 12*a* and $\mathbf{12}a_1$. In FIG. 16, Y-direction rows $\mathbf{12}b_1$ are then placed along the longer longitudinal sides of the tool 38 and are adhered to the edges of rows 12*a* and $\mathbf{12}a_1$ by the adhesive 54. The entire assembly of FIG. 16 is then covered with a top plate 56. Top plate 56 is also shown in FIG. 17 and has a lower surface 58 having a plurality of recesses 60 for accepting the upper locating pins 46 of each metallic block 42. Top plate 56, in combination with base plate 40, thus holds each of the metallic blocks 42 in precise alignment to maintain the X-direction slots 28 and Y-direction slots 28 in a substantially perpendicular configuration.

Initial Bonding of Wall Sections

Figure 21:
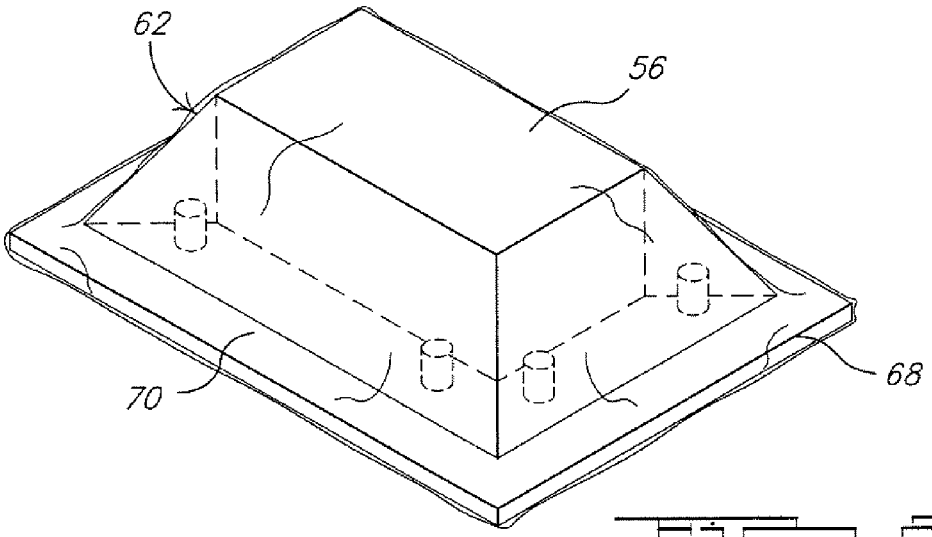
FIG. 21 is an illustration of a view of the tool of FIG. 18 in a compaction bag, while a compaction operation is being performed.

Referring to FIGS. 18 and 19, the entire assembly of FIG. 16 is placed within four components 62*a*-62*d* of a tool 62. Each of sections 62*a*-62*d* includes a pair of bores 64 that receive a metallic pin 66 therethrough. One of the tool sections 62*d* is shown in FIG. 20 and can be seen to be slightly triangular when viewed from an end thereof. In FIGS. 18 and 19 the pins 66 are received within openings in a table 68 to hold the subassembly of FIG. 16 securely during a cure phase. Tool 62, as well as top plate 56 and base plate 40, are all preferably formed from for example and without limitation Invar. In FIG. 21 the tool 62 is covered with a vacuum bag 70 and the subassembly within the tool 62 is bonded. Bonding typically takes from 4-6 hours. The blocks 42 expand during the compacting phase to help provide the compacting force applied to the wall sections 12.

Figure 22:
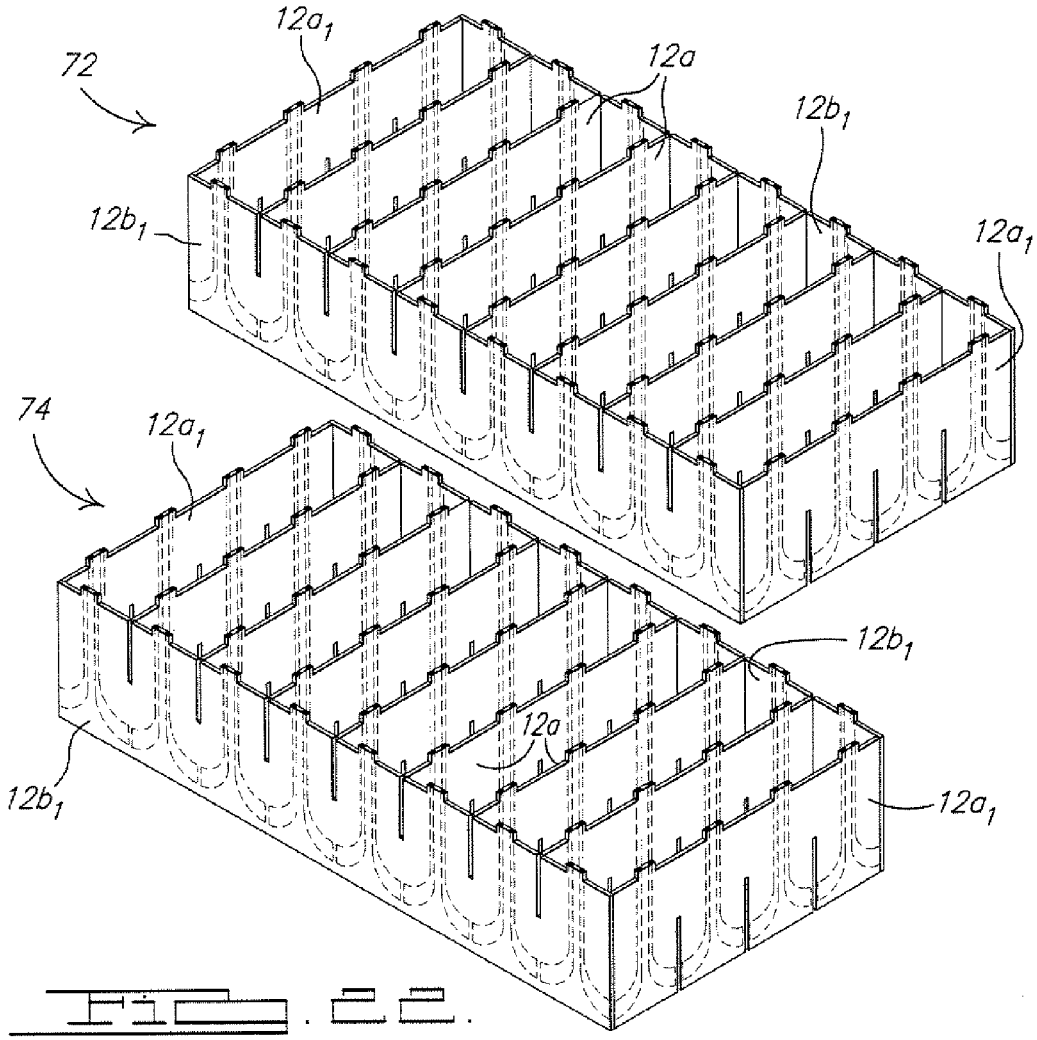
FIG. 22 is an illustration which illustrates the two independent subassemblies formed during a compaction step of FIG. 21 after removal from the compacting tool.

Referring to FIG. 22, after the compacting step shown in FIG. 21 is performed, the tool 62 is removed, the top plate 56 is removed and a pair of independent subassemblies 72 and 74 each made up of wall sections 12*a*, 12*a*$_1$ and 12*b*$_1$ are provided. Each of subassemblies 72 and 74 form rigid, lightweight subassemblies.

Formation of Grid and Securing of Back Skin

Figure 23:
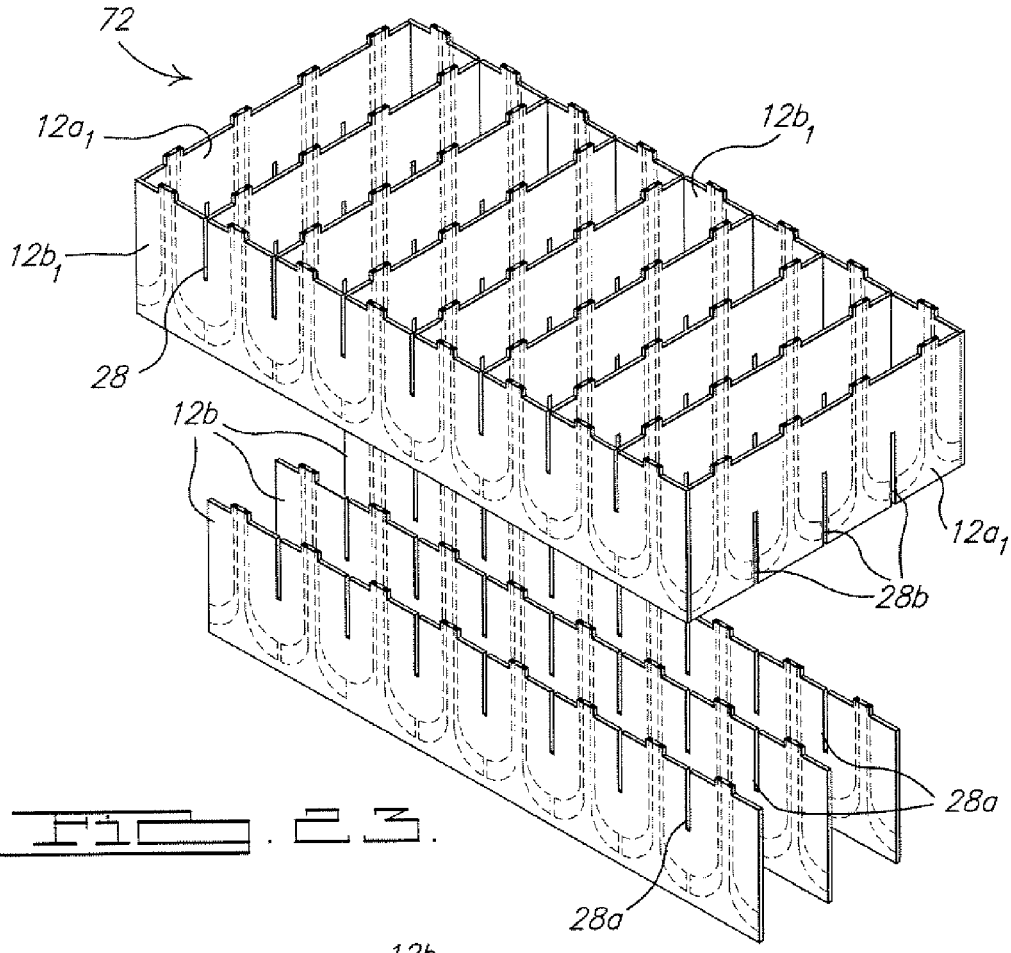
FIG. 23 is an illustration which illustrates Y-direction wall portions being inserted into one of the previously formed subassemblies shown in FIG. 22.
Figure 24:
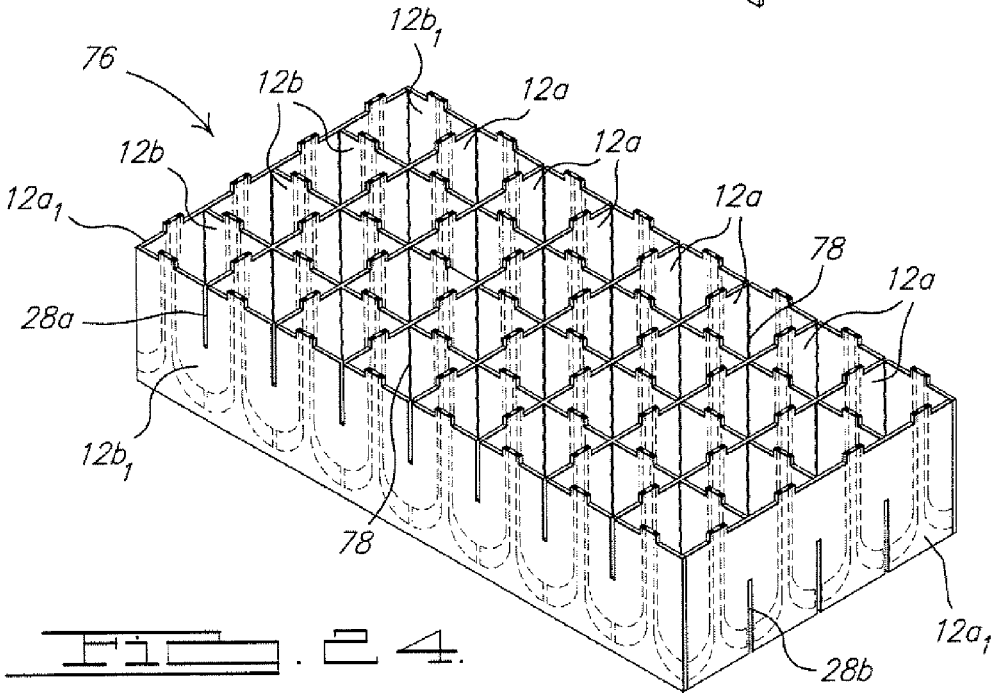
FIG. 24 is an illustration which shows the areas in which adhesive is placed for bonding intersecting areas of the wall sections.

Referring to FIG. 23, the completion of subassembly 72 will be described. The completion of assembly of subassembly 74 is identical to what will be described for subassembly 72. In FIG. 23, a plurality of wall sections 12*b* are inserted into the Y-direction slots 28 of the subassembly 72 to form columns. The wall sections 12*b* are inserted such that slots 28*a* intersect with slots 28*b*. The resulting subassembly, designated by reference numeral 76, is shown in FIG. 24. Adhesive 78 is then placed at each of the interior joints of the subassembly 76 where wall portions 12*a* and 12*b* meet. The adhesive 78 may be applied with a heated syringe or any other suitable means that allows the corners where the wall sections 12 intersect to be lined with an adhesive bead.

Figure 25:
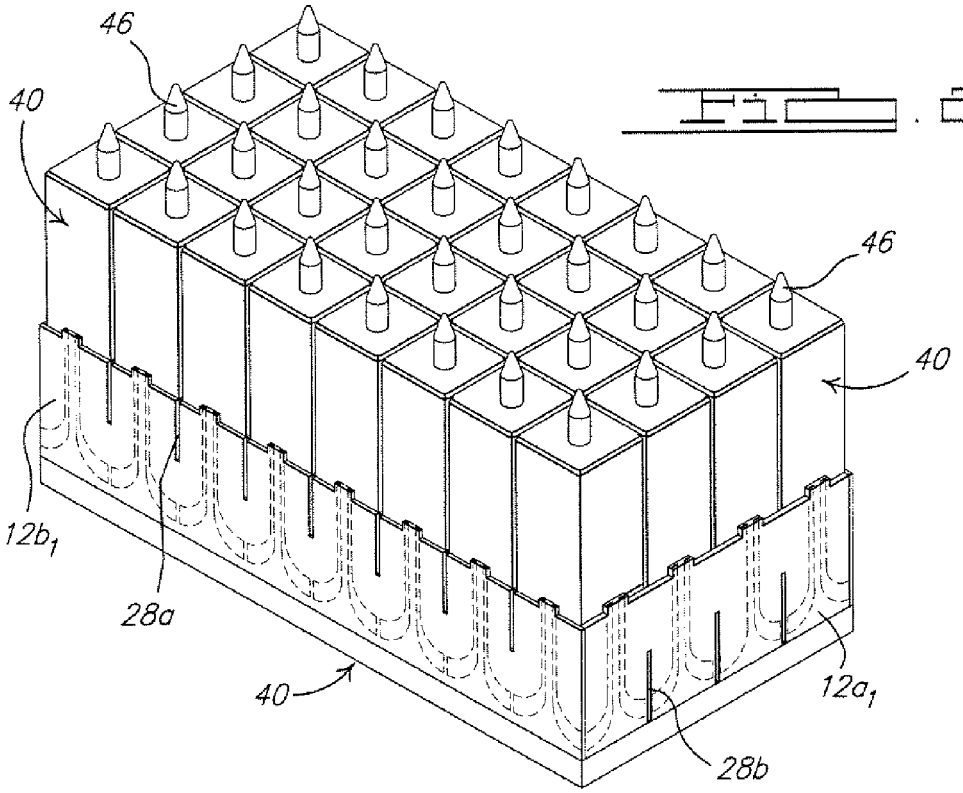
FIG. 25 is an illustration which shows the subassembly of FIG. 24 after it has been lowered onto the alignment tool.
Figure 26:
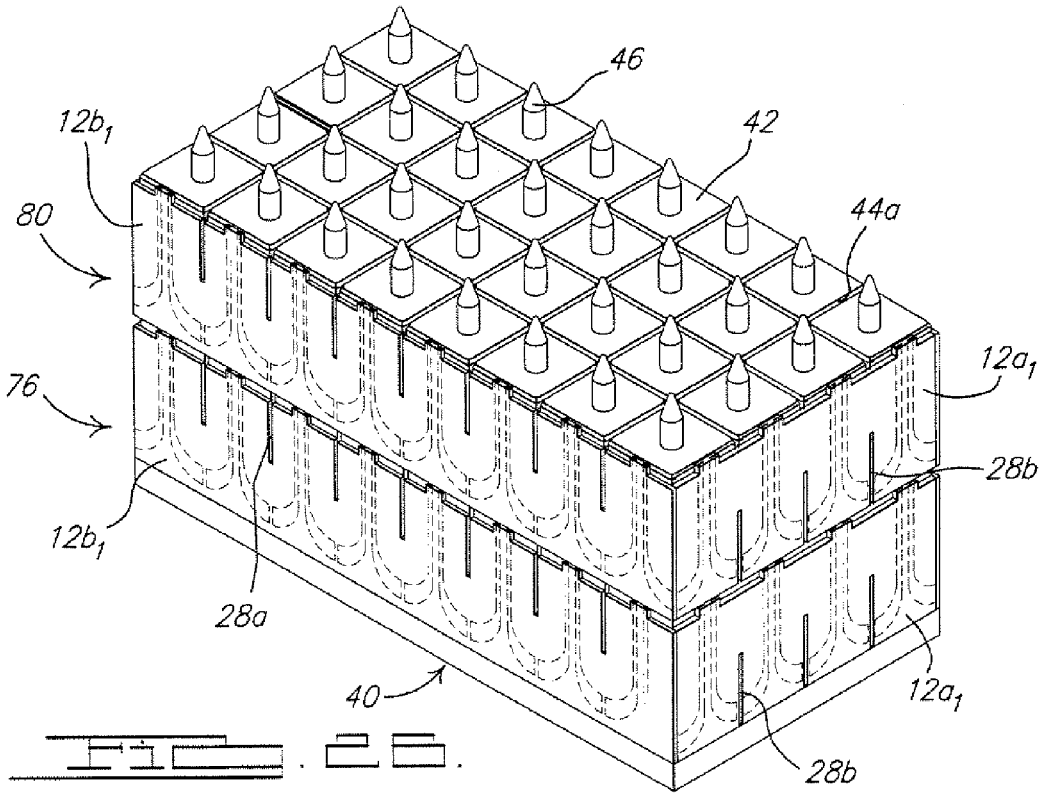
FIG. 26 is an illustration which shows both of the aperture subassemblies positioned on the alignment tool and ready for compacting and curing.

Referring to FIG. 25, the resulting subassembly 76 is placed over the tool 38 and then an subassembly 80, formed from subassembly 74, is placed on top of subassembly 76. Any excess adhesive that rubs off onto the tapered edges 44*a* of each of the metallic blocks 42 is manually wiped off.

Figure 27:
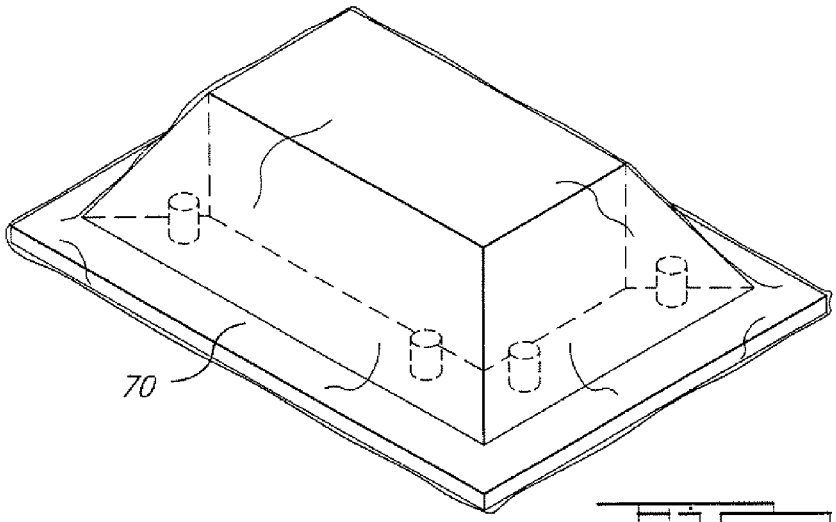
FIG. 27 is an illustration which illustrates the subassembly of FIG. 26 again placed within the compaction tool initially shown in FIG. 18.

Referring to FIG. 27, a second bond/compaction cycle is performed in a manner identical to that described in connection with FIGS. 18-21. Again, the thermal expansion of the blocks 40 may help to provide the additional compaction force on the wall sections 12.

Figure 28:
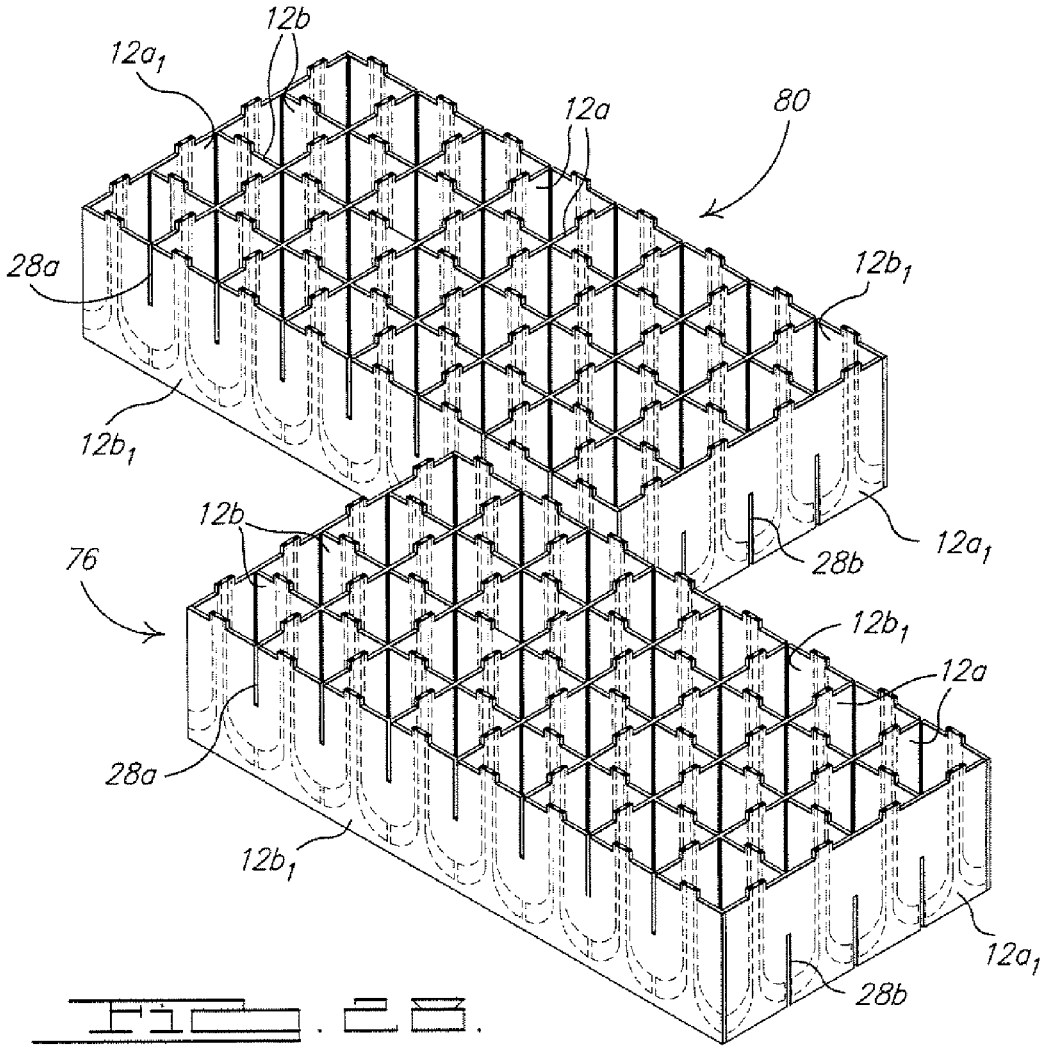
FIG. 28 is an illustration which shows the two independent aperture subassemblies formed after removal from the tool in FIG. 27.

Referring to FIG. 28, after the bond/compaction operation of FIG. 27 is completed, the two subassemblies 80 and 76 are removed from the tool 62 and then from the tool 38. Each of subassemblies 80 and 76 form rigid, lightweight, structurally strong assemblies having a plurality of cells 76*a* and 80*a*. The size of the cells 80*a*, 76*a* may vary depending on desired antenna performance factors and the load bearing requirements that the antenna aperture 10 must meet. The specific dimensions of the antenna elements 14 will generally be in accordance with the length and height of the individual cells 80*a*, 76*a*. In one preferred form suitable for antenna or sensor applications in the GHz range, the cells 76*a* and 80*a* are about 0.5 inch in length×0.5 inch in width×0.5 inch in height (12.7 mm×12.7 mm×12.7 mm) The overall length and width of each subassembly 76 and 80 will vary depending on the number of radiating elements 14 that are employed, but can be on the order of about 1.0 ft×1.0 ft (30.48 cm×30.48 cm), and subsequently secured adjacent to one another to form a single array of greater, desired dimensions. The fully assembled antenna system 10 may vary from several square feet in area to possibly hundreds of square feet in area or greater. While the cells 80*a*, 76*a* are illustrated as having a square shape, other shaped cells could be formed, such as triangular, round, hexagonal, etc.

Figure 29:
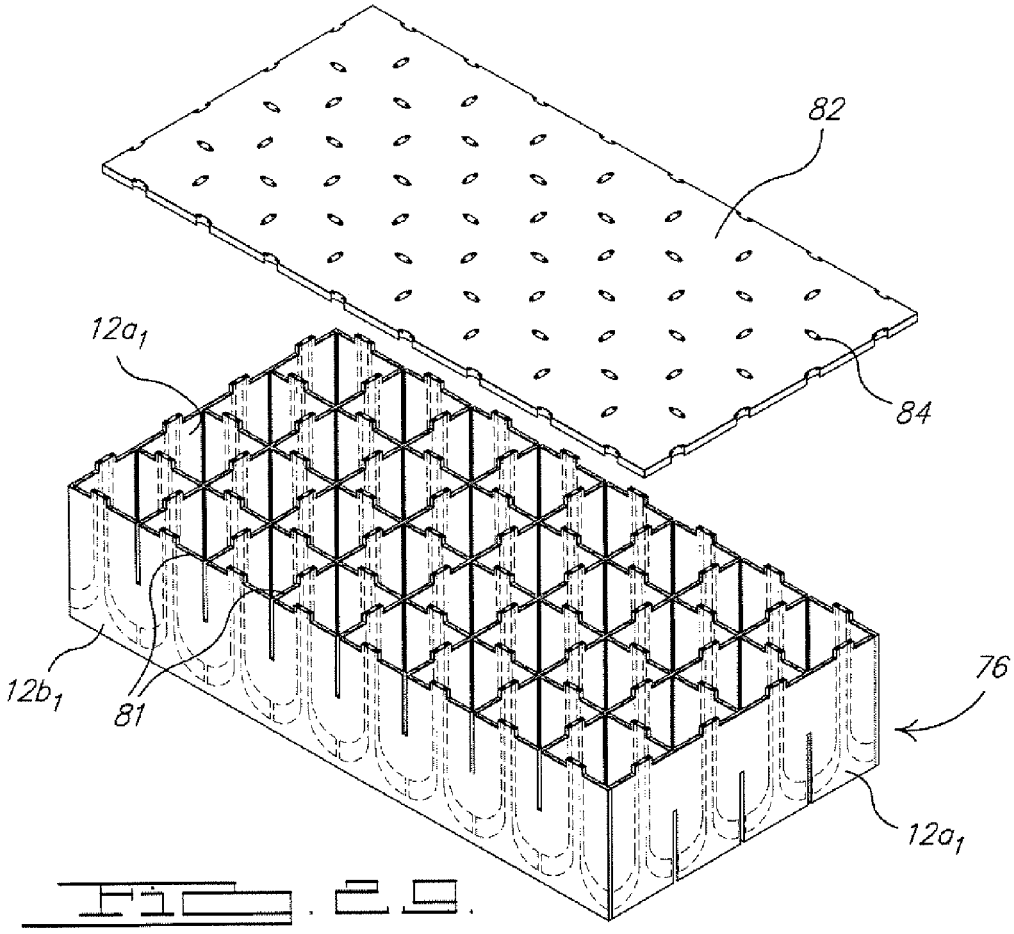
FIG. 29 is an illustration which illustrates a back skin being secured to one of the antenna aperture assemblies of FIG. 28.

Referring to FIG. 29, beads of adhesive 81 are placed along each exposed edge of each of the wall sections 12. A back skin 82 having a plurality of precisely machined openings 84 is then placed over each subassembly 80 and 76 such that the teeth 14*a* of each radiating element 14 project through the openings 84. The back skin 82 is preferably an impregnated composite material sheet that has been previously cured to form a structurally rigid component. In one preferred form the back skin 82 is comprised of a plurality of layers of Astroquartz® impregnated fibers preimpregnated with Cyanate Ester resin. The thickness of the backskin 82 may vary as needed to suit specific load bearing requirements. The higher the load bearing capability required, the thicker the backskin 82 will need to be. In one preferred form the backskin 82 has a thickness of about 0.050 inch (1.27 mm), which together with wall sections 12 provides the aperture 10 with a density of about 8 lbs/cubic foot (361 kg/cubic meter). The backskin 82 could also be formed with a slight curvature or contour to match an outer mold line of a surface into which the antenna aperture 10 is being integrated.

Figure 30:
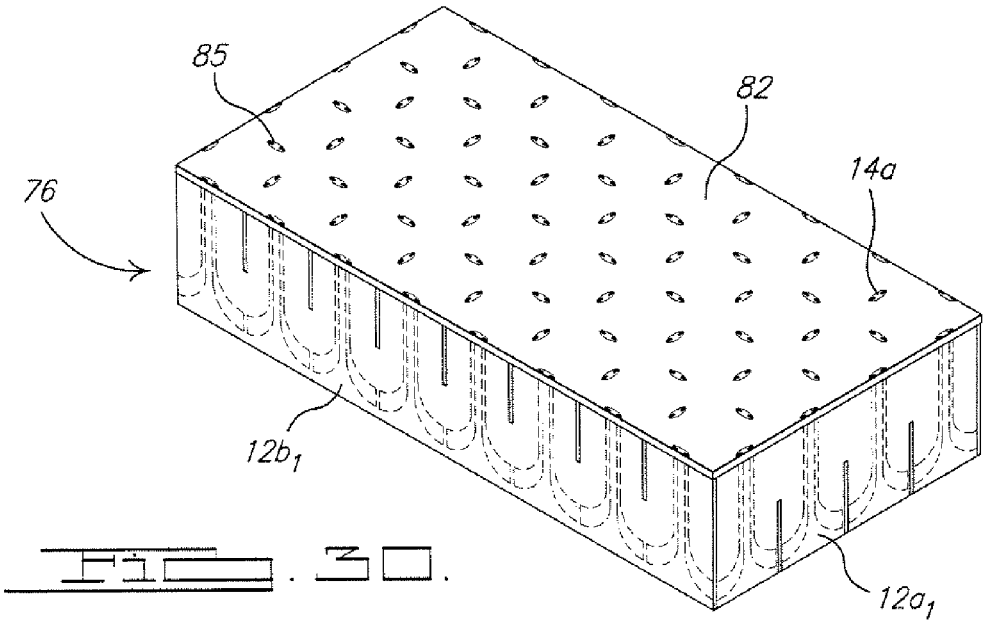
FIG. 30 is an illustration which illustrates the filled holes in the back skin, thus leaving only teeth on the radiating elements exposed.

In FIG. 30, after the back skin 82 is placed on the assembly 76, the openings 84 are filled with an epoxy 85 such that only the teeth 14*a* of each radiating element 14 are exposed. The back skin is then compacted onto the remainder of the subassembly and cured in an autoclave for preferably 2-4 hours at a temperature of about 250° F.-350° F., at a pressure of about 80-90 psi. The adhesive beads 81 and 54 form fillets that help to provide the aperture 10 with excellent structural strength.

Alternative Assembly Method of Wall Sections

Figure 31:
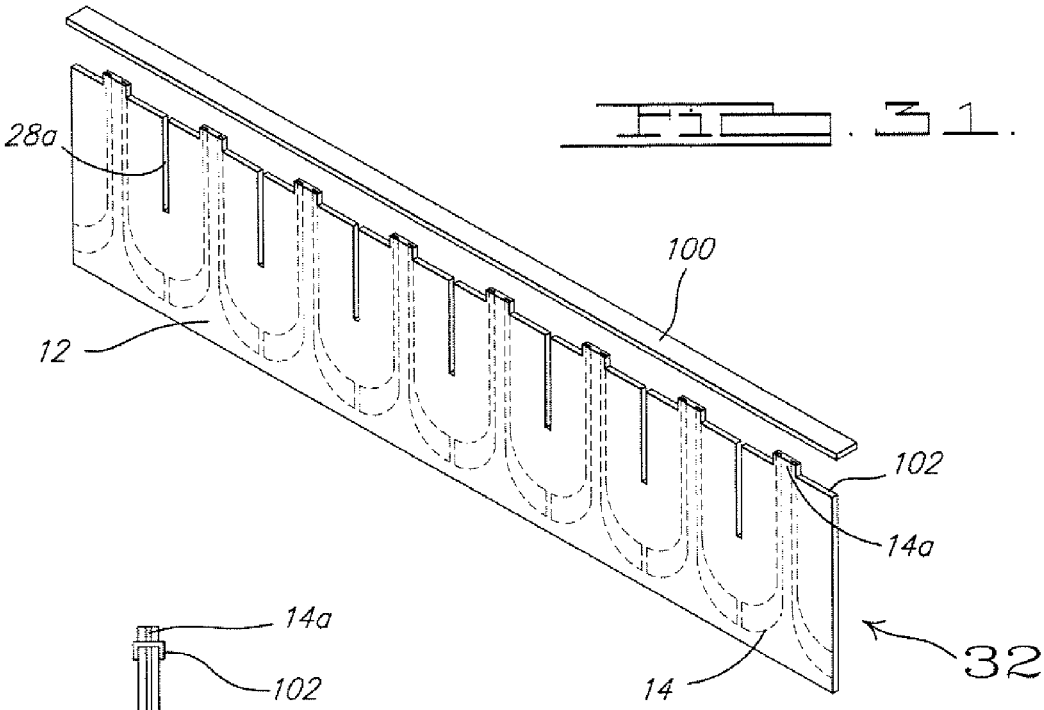
FIG. 31 is an illustration of a perspective view of the wall section and an adhesive strip for use in connection with an alternative preferred method of construction of the antenna aperture.
Figure 32:
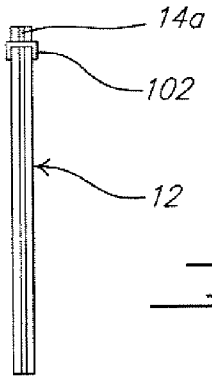
FIG. 32 is an illustration of an end view of the wall section of FIG. 31 with the adhesive strip of FIG. 31.
Figure 33:
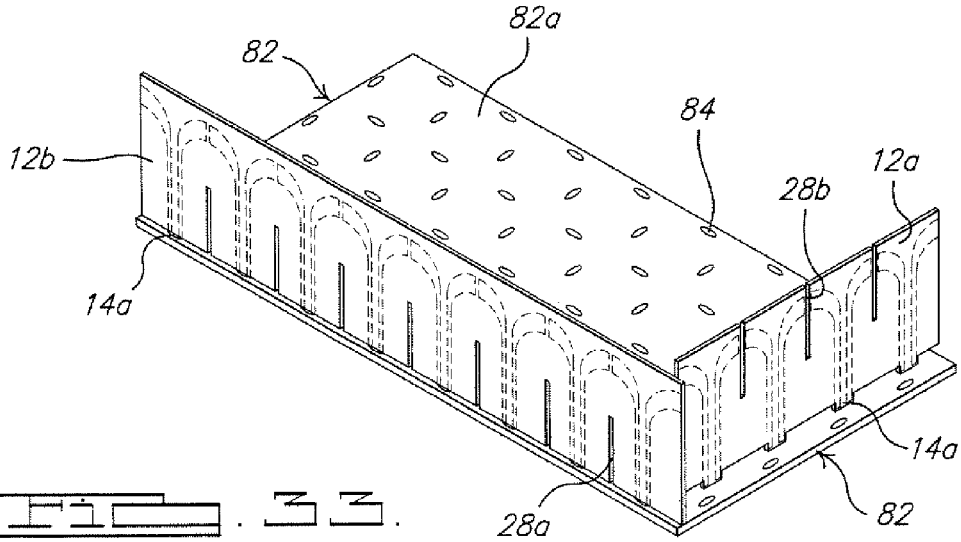
FIG. 33 is an illustration of a perspective view of the wall sections being secured to a back skin.

Referring to FIGS. 31-37, an alternative preferred method of constructing the antenna aperture 10 is shown. With this method, the wall sections 12 are assembled as a complete X-Y grid onto a backskin, then the entire assembly is cured in one step. Referring specifically to FIG. 31, each wall section 12 has an adhesive strip 100 pressed over an edge 102 adjacent the teeth 14*a* of the radiating elements 14. Adhesive strip 100 is preferably about 0.015 inch thick (0.38 mm) and has a width of preferably about 0.10 inch (2.54 mm) The strip 14 can be a standard, commercially available epoxy or Cyanate Ester film. The strip 100 is pressed over the teeth such that the teeth 14*a* pierce the strip 100. The strip 100 is tacky and temporarily adheres to the upper edge 102. Referring to FIG. 32, portions of the adhesive strip 102 are folded over opposing sides of the wall section 12. This is performed for each one of the X-direction walls 12*a* and each one of the Y-direction walls 12*b*. Referring to FIG. 33, each of the wall sections 12*a* and 12*b* are then assembled onto the backskin 82 one by one. This involves carefully aligning and using sufficient manual force to press each of the teeth 14*a* on each wall section 12 through the openings 84 in the backskin 82. The adhesive strips 102 help to hold each of the wall sections 12 in an upright orientation. The interlocking connections of the wall sections 12*a* and 12*b* also serve to temporarily hold the wall sections 12 in place.

Figure 34:
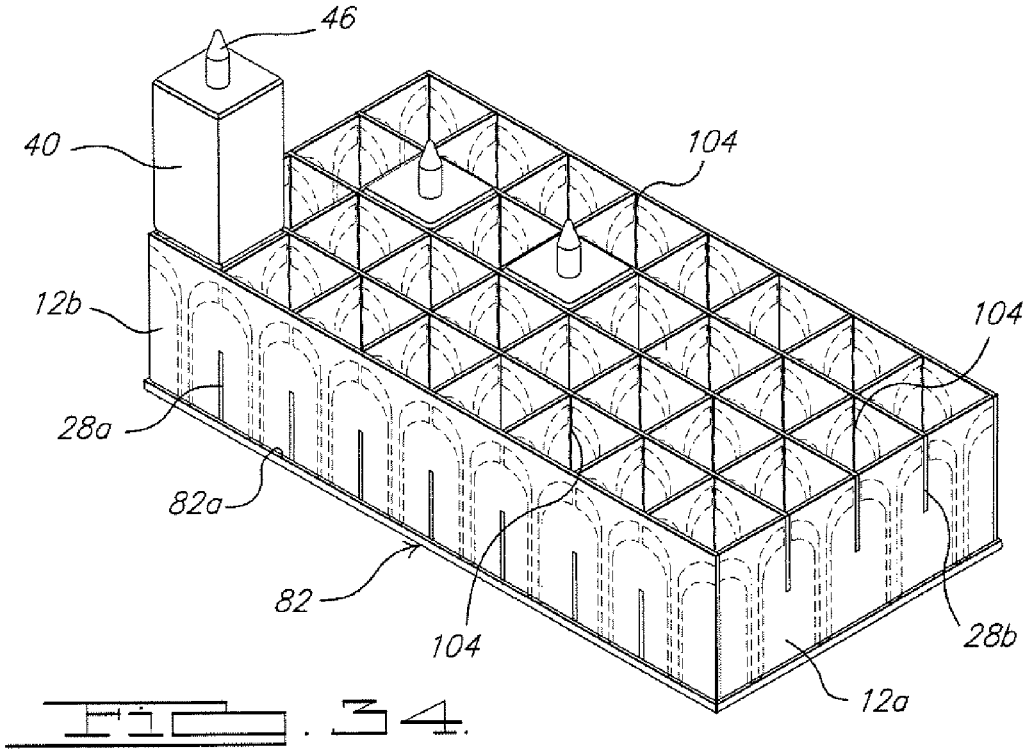
FIG. 34 is an illustration of a view of the wall sections secured to the backskin with the metallic blocks being inserted into the cells formed by the wall sections.

Referring to FIG. 34, adhesive beads 104 are then applied at each of the areas where wall sections 12*a* and 12*b* intersect. The metallic blocks 40 are then inserted into each of the cells formed by the wall sections 12*a* and 12*b*. The insertion of each metallic block 40 helps to form the adhesive beads 104 into fillets at the intersections of each of the wall sections 12. Excess adhesive is then wiped off from the metallic blocks 40 and from around the intersecting areas of the wall sections 12.

Figure 35:
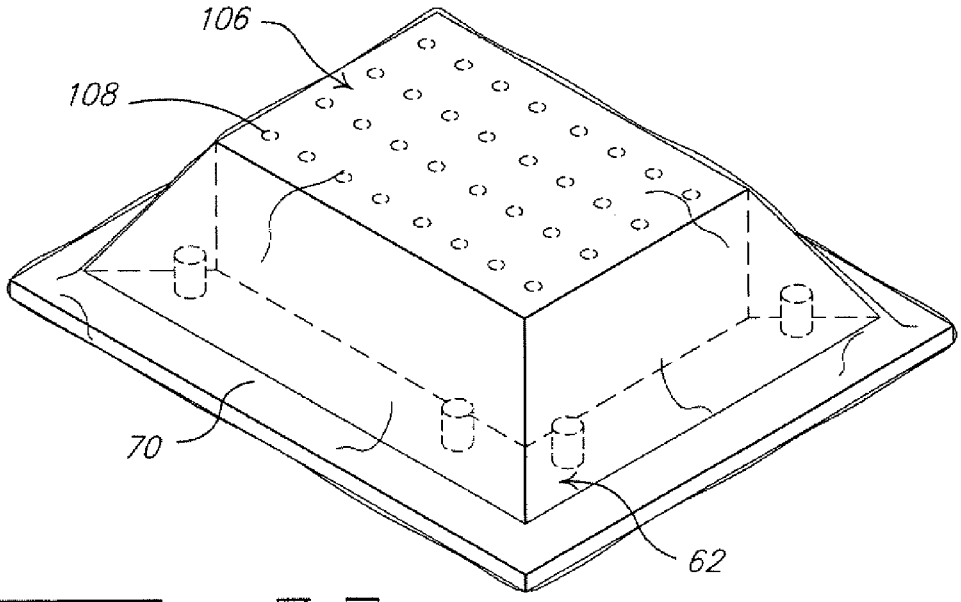
FIG. 35 is an illustration of a view of the assembly of FIG. 34 being vacuum compacted.
Figure 36:
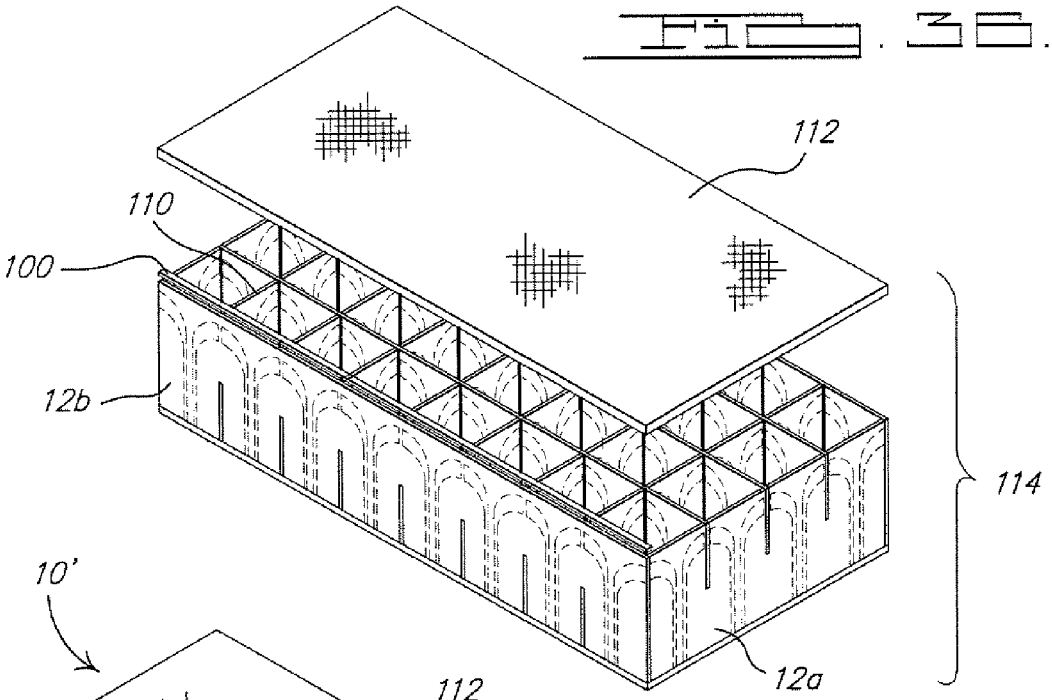
FIG. 36 is an illustration of a view of a radome positioned over the just-compacted subassembly, with adhesive strips being positioned over exposed edge portions of the wall sections.
Figure 37:
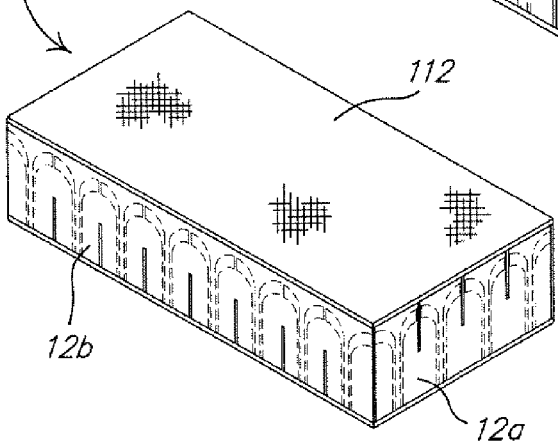
FIG. 37 is an illustration of a view of the compacted and cured assembly of FIG. 36.
Figure 38:
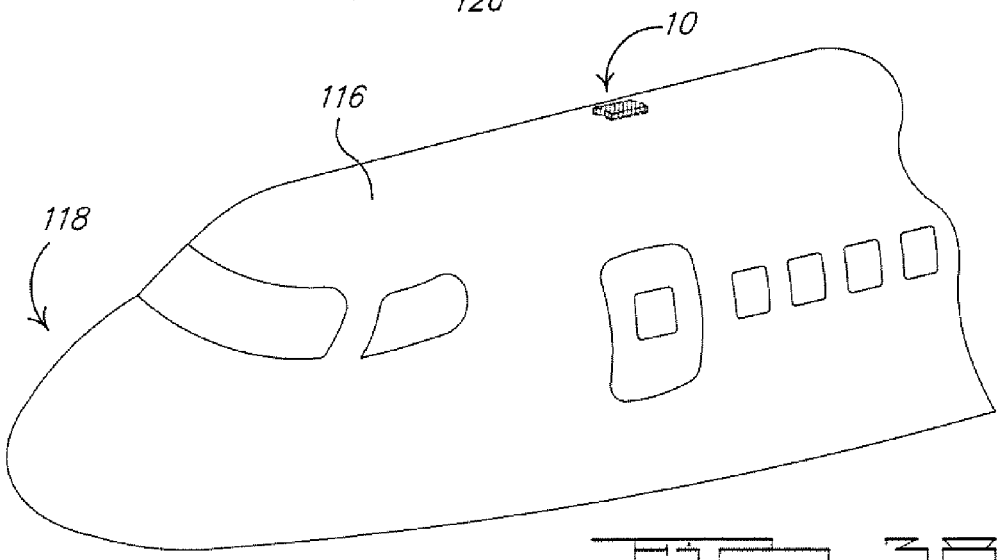
FIG. 38 is an illustration which illustrates the antenna aperture integrally formed with a fuselage of an aircraft.

Referring to FIG. 35, a metallic top plate 106 having a plurality of recesses 108 is then pressed onto the upper locating pins 46 of each of the metallic blocks 40. The assembly is placed within vacuum bag 70 and bonded using tool 62. Referring to FIG. 36, the assembly is removed from the tool 62, top plate 106 is removed, and the metallic blocks 40 are removed. Adhesive strips 100 and 110 are then pressed over exposed edge portions of each of the wall sections 12*a* and 12*b* in the same manner as described in connection with FIGS. 31 and 32. Adhesive strips 110 are identical to strips 100 but just shorter in length. A precured front skin (i.e., radome) 112 is then positioned over the exposed edges of the wall sections 12*a* and 12*b* and pressed onto the wall sections 12*a* and 12*b* to form an assembly 114. Assembly 114 is then vacuum compacted and cured in an autoclave for preferably 2-4 hours at a temperature of preferably about 250° F.-350° F. (121° C.-176° C.), and at a pressure of preferably around 85 psi. The cured assembly 114 is shown in FIG. 37 as antenna aperture 10'. In FIG. 38, the antenna aperture 10 is shown forming a portion of a fuselage 116 of an aircraft 118.

Figure 38A:
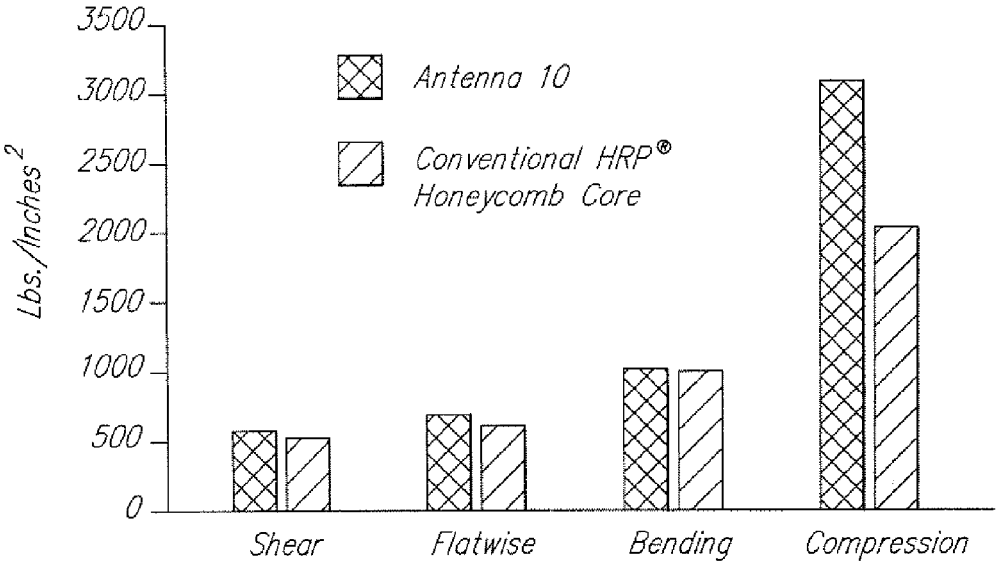
FIG. 38*a* is an illustration of a graph illustrating the structural strength of the antenna aperture relative to a conventional phenolic core structure.

The structural performance and strength of the antenna aperture 10 is comparable to a composite, HRP® core structure, as illustrated in FIG. 38*a*.

The antenna aperture 10, 10' is able to form a primary aircraft component for a structure such as a commercial aircraft or spacecraft. The antenna aperture 10, 10' can be integrated into a wing, a door, a fuselage or other structural portion of an aircraft, spacecraft or mobile platform. Other potential applications include the antenna aperture 10 forming a structural portion of a marine vessel or land based mobile platform.

Further Alternative Construction of Antenna Aperture

Figure 39:
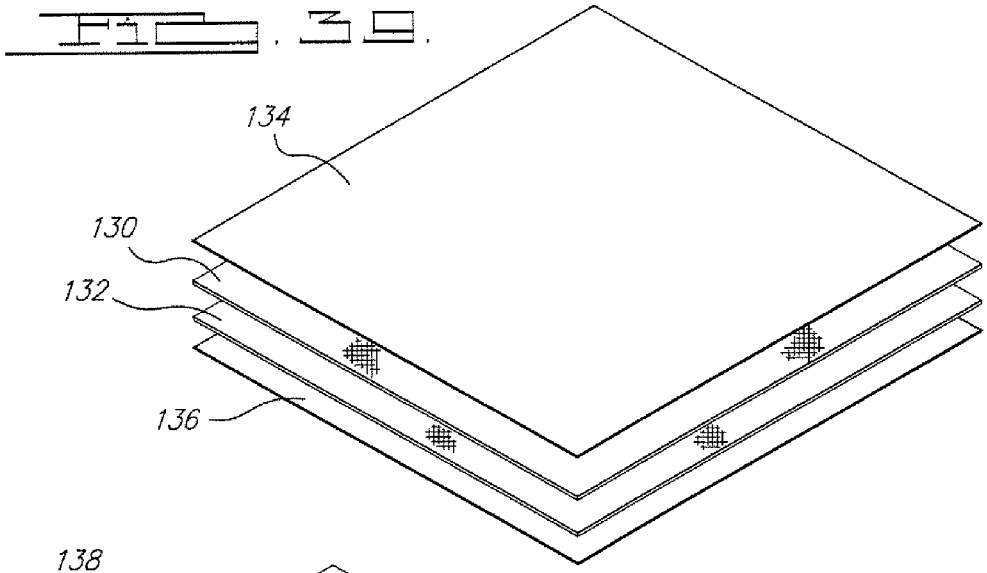
FIG. 39 is an illustration which shows an alternative preferred construction for the wall sections that employs prepreg fabric layers sandwiched between metallic foil layers.
Figure 40:
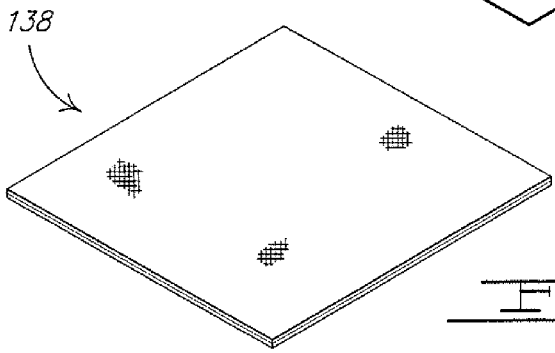
FIG. 40 is an illustration which illustrates the layers of material shown in FIG. 39 formed as a rigid sheet.

Referring to FIGS. 39-51, an alternative method of constructing each of the wall sections 12 of the antenna aperture 10 will be described. Referring initially to FIG. 39, two plies of resin rich impregnated fabric 130 and 132 are sandwiched between two layers of metallic material 134 and 136. In one preferred form layers 130 and 132 are comprised of Astroquartz® fibers preimpregnated with Cyanate Ester resin. Metallic layers 134 and 136 preferably comprise copper foil having a density of about 0.5 ounce/ft.$^2$ Layers 130-136 are cured flat in an autoclave to produce a rigid, unitary sheet 138 shown in FIG. 40.

Figure 41:
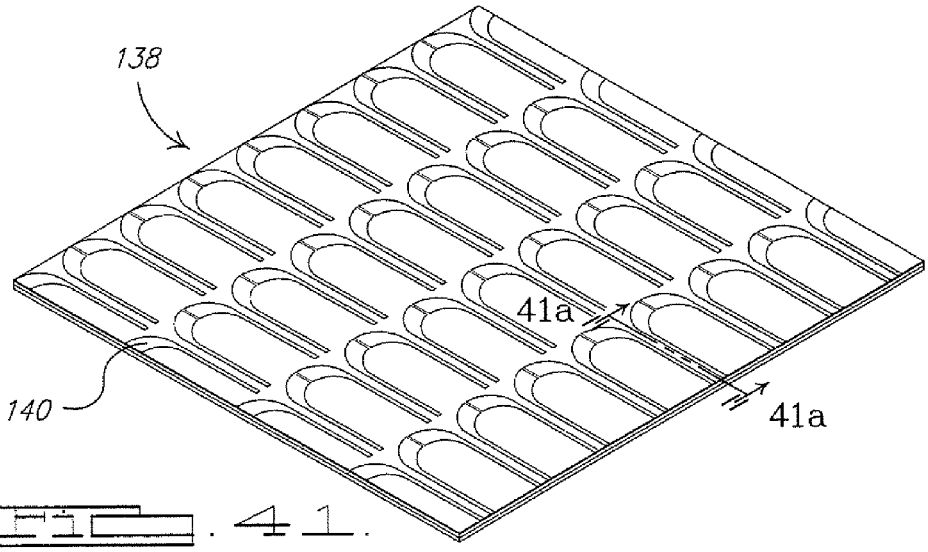
FIG. 41 is an illustration which illustrates one surface of the sheet shown in FIG. 40 having electromagnetic radiating elements.
Figure 41A:
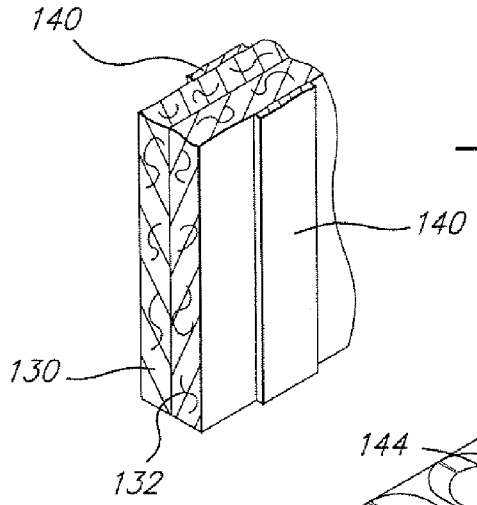
FIG. 41*a* is an illustration of an end view of a portion of the sheet of FIG. 41 illustrating the electromagnetic radiating elements on opposing surfaces of the sheet.

Referring to FIGS. 41 and 41*a*, portions of the metallic layers 134 and 136 are etched away to form dipole electromagnetic radiating elements 140 that are arranged in adjacent rows on both sides of the sheet 138. Resistors or other electronic components could also be screen printed onto each of the radiating elements 140 at this point if desired.

Figure 42:
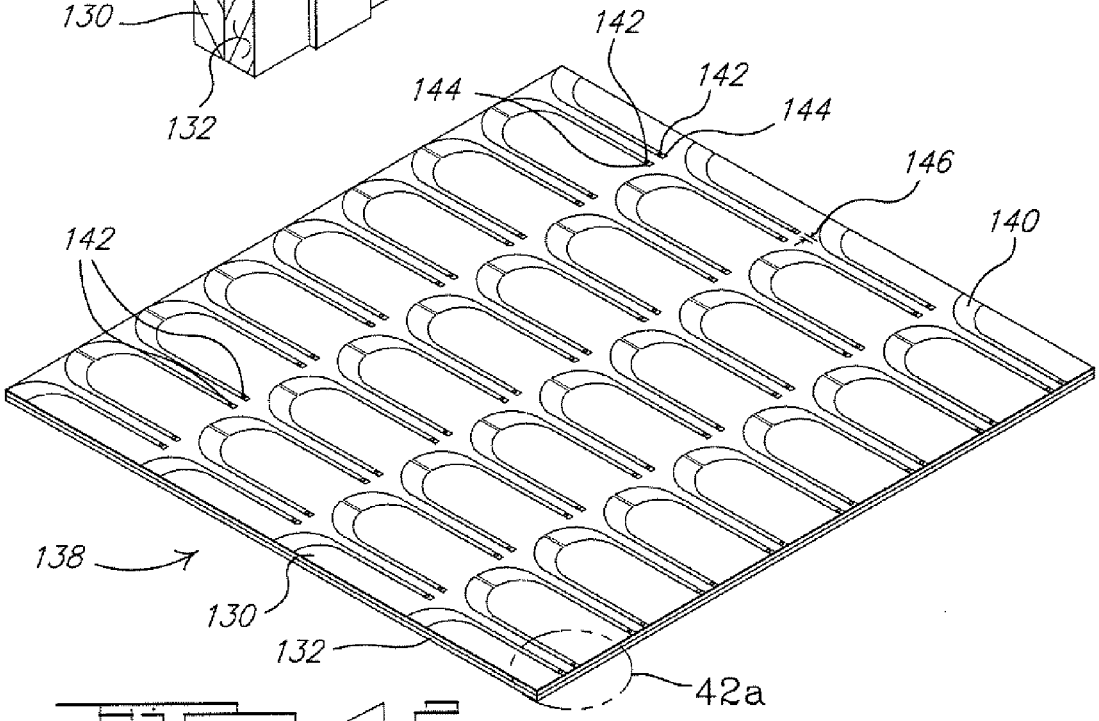
FIG. 42 is an illustration which illustrates the holes and electrically conductive pins formed at each feed portion of each electromagnetic radiating element.
Figure 42A:
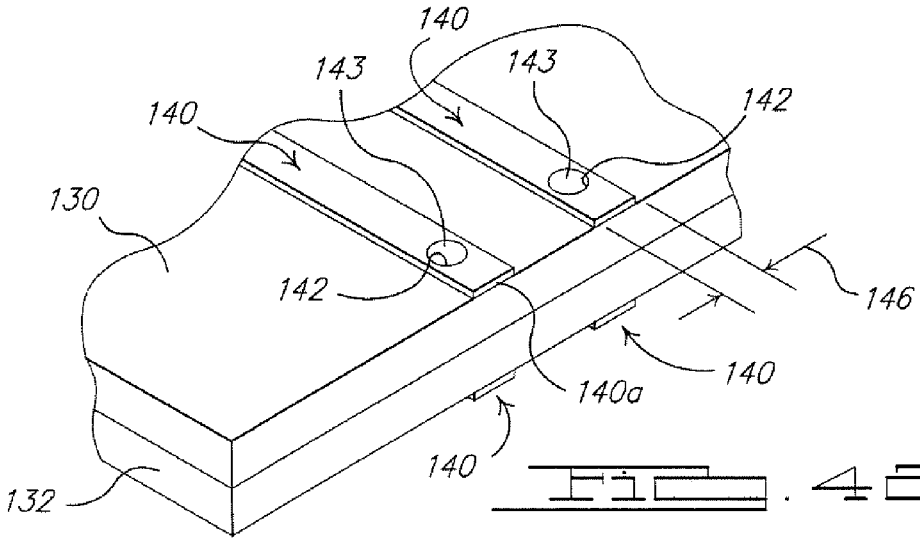
FIG. 42*a* is an illustration which shows in enlarged, perspective fashion the electrically conductive pins that are formed at each feed portion.

Referring to FIGS. 42 and 42*a*, holes 142 are drilled completely through the sheet 138 at feed portions 144 of each radiating element 140. The holes 142 are preferably about 0.030 inch (0.76 mm) in diameter but may vary as needed depending upon the width of the feed portion 144. Preferably, the diameter of each hole 142 is approximately the same or just slightly smaller than the width 146 of each feed portion 144. The holes 142 are further formed closely adjacent the terminal end of each of the feed portions 144 but inboard from an edge 140*a* of each feed portion 144. Each hole 142 is filled with electrically conductive material 143 to form a "pin" or via that electrically couples an opposing, associated pair of radiating elements 140.

Figure 43:
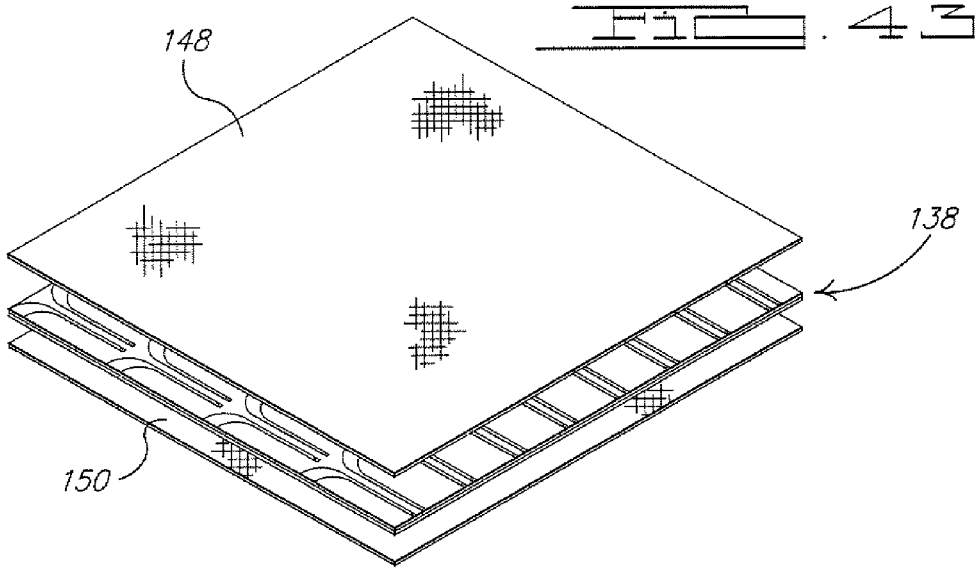
FIG. 43 is an illustration which illustrates the material of FIG. 42 being sandwiched between an additional pair of prepreg fabric plies.

Referring to FIG. 43, sheet 138 is then sandwiched between at least a pair of additional plies of impregnated fabric 148 and 150. Plies 148 and 150 are preferably formed from Astroquartz® fibers impregnated with Cyanate Ester resin. Each of the plies 148 and 150 may vary in thickness but are preferably about 0.005 inch (0.127 mm) in thickness.

Figure 44:
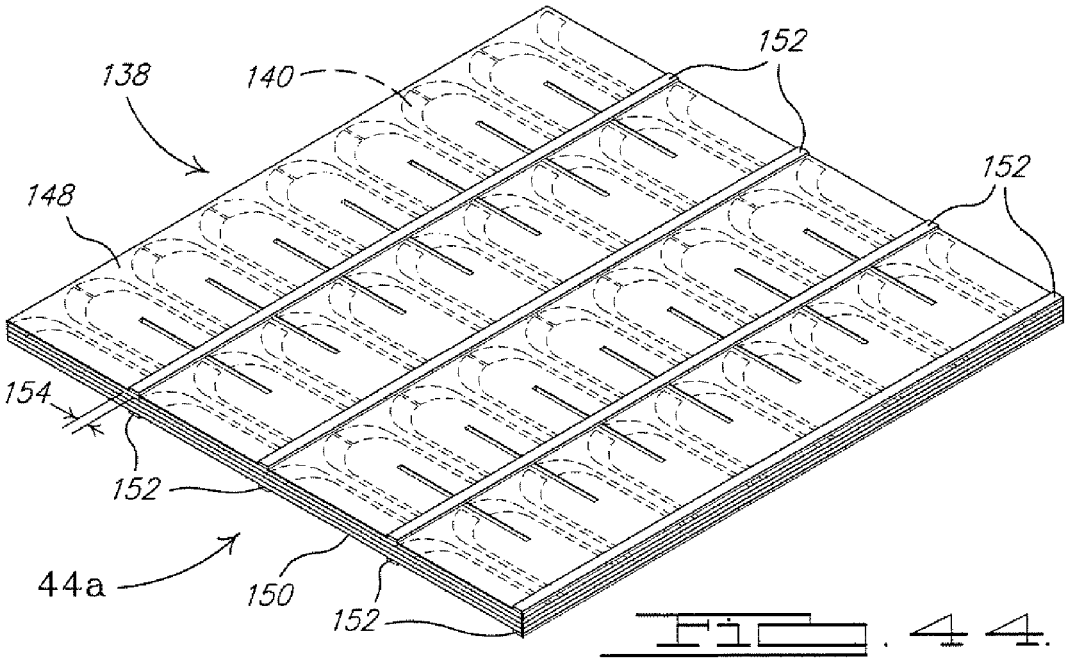
FIG. 44 is an illustration which illustrates metallic strips being placed along the feed portions of each electromagnetic radiating element.
Figure 44A:
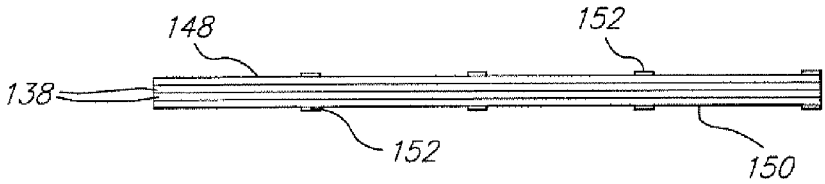
FIG. 44*a* is an illustration which illustrates the metallic strips placed on opposing surfaces of the sheet shown in FIG. 44.

Referring to FIGS. 44 and 44*a*, planar metallic strips 152 are placed along the feed portions 144 of each radiating element 140 on both sides of the sheet 138 to completely cover the holes 142. Metallic strips 152, in one preferred form, comprise copper strips having a thickness of preferably about 0.001 inch (0.0254 mm) and a width 154 of about 0.040 inch (1.02 mm) Again, these dimensions will vary in accordance with the precise shape of the radiating elements 140, and particularly the feed portions 144 of each radiating element. Sheet 138 with the metallic strips 152 is then cured in an autoclave to form an assembly 138'. Autoclave curing is performed at about 85 psi, 250° F.-350° F., for about 2-6 hours.

Figure 45:
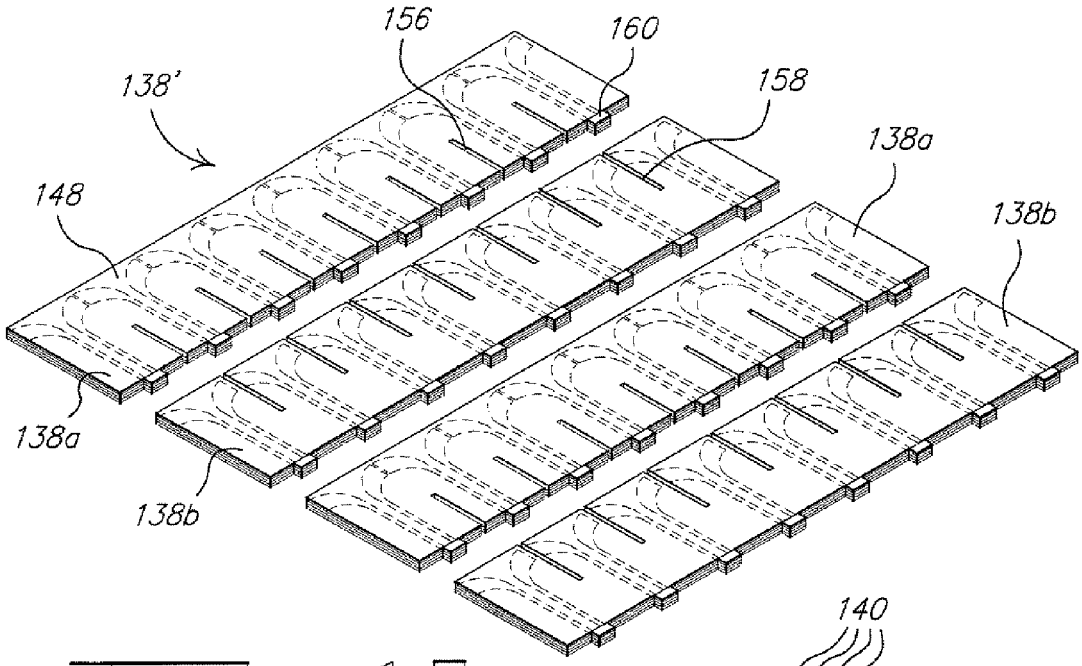
FIG. 45 is an illustration which illustrates the sheet of FIG. 40 cut into a plurality of lengths of material that form wall sections with each wall section being notched such that the feed portions of adjacent radiating elements form a tooth.

Referring to FIG. 45, sheet 138' is then cut into a plurality of lengths that form wall sections 138*a* and 138*b*. Wall sections 138*a* each then are cut to form notches 156, such as by water jet cutting or any other suitable means. Wall sections 138*b* similarly have notches 158 formed therein such as by water jet cutting. The notches 156 and 158 could also be formed before cutting the sheet 138 into sections.

Each of the wall sections 138*a* and 138*b* further have material removed from between the feed portions 144 of the radiating elements 140 so that the feed portions form projecting "teeth" 160. The teeth 160 are used to electrically couple circuit traces of an independent antenna electronics board to the radiating elements 140.

Figure 46:
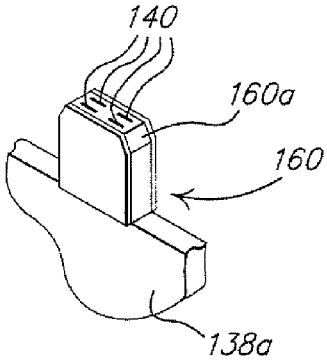
FIG. 46 is an illustration which shows an enlarged perspective view of an alternative preferred form of one tooth in which edges of the tooth are tapered.

Referring to FIG. 46, each tooth 160 could alternatively be formed with tapered edges 160*a* to help ease assembly of the wall sections 138*a* and 138*b*.

Figure 47:
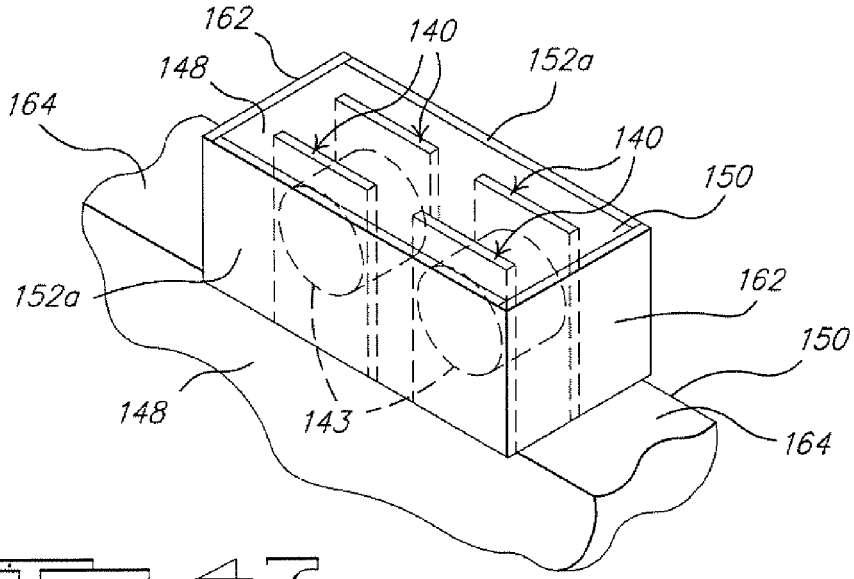
FIG. 47 is an illustration which illustrates an enlarged portion of one of the teeth of the wall section shown in FIG. 45.

Referring to FIG. 47, one tooth 160 of wall section 138*a* is shown. Tooth 160 has resulting copper plating portions 152*a* remaining from the copper strips 152. Side wall portions 162 of each tooth 160, as well as surface portions 164 between adjacent teeth 160, are also preferably plated with a metallic foil, such as copper foil, in a subsequent plating step. All four sidewalls of each tooth 160 are thus covered with a metallic layer that forms a continuous shielding around each tooth 160.

Alternatively, each tooth 160 could be electrically isolated by using a conventional combination of electroless and electrolytic plating. This process would involve covering both sides of each of the wall sections 138*a* and 138*b* with copper foil, which is necessary for the electrolytic plating process. Each wall section 138*a* and 138*b* would be placed in a series of tanks for cleaning, plating, rinsing, etc. The electroless process leaves a very thin layer of copper in the desired areas, in this instance on each of the feed portions 144 of each radiating element 140. The electrolytic process is used to build up the copper thickness in these areas. The process uses an electric current to attract the copper and the solution. After the electrolytic process is complete and the desired amount of copper has been placed at the feed portions 144, each of the wall sections 138*a* and 138*b* are subjected to a second photo etching step which removes the bulk of the copper foil covering the surfaces of wall sections 138*a* and 138*b* so that only copper in the feed areas 144 is left.

Instead of Astroquartz® fibers, stronger structural fibers like graphite fibers, can be used. Thus, graphite fibers, which are significantly structurally stronger than Astroquartz® fibers, but which do not have the electrical isolation qualities of Astroquartz® fibers, can be employed in the back skin. For a given load-bearing capacity that the antenna aperture 10 must meet, a back skin employing graphite fibers will be thinner and lighter than a backskin of equivalent strength formed from Astroquartz® fibers. The use of graphite fibers to form the backskin therefore allows a lighter antenna aperture 10 to be constructed, when compared to a back skin employing Astroquartz® fibers, for a given load bearing requirement.

Figure 48:
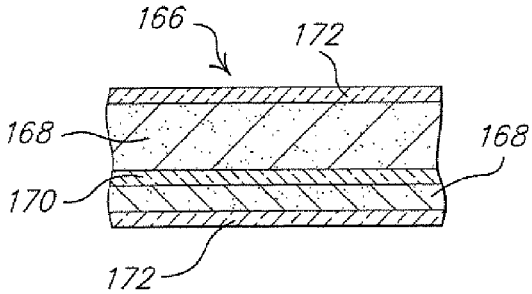
FIG. 48 is an illustration which shows a portion of an alternative preferred construction of a back skin for the antenna aperture.

Referring to FIG. 48, a cross section of a back skin 166 is shown that employs a plurality of plies of graphite fibers 168. A metallic layer 170, preferably formed from copper, is sandwiched between two sections of graphite plies 168. Fiberglass plies 172 are placed on the two graphite plies 168. The assembly is autoclave cured to form a rigid skin panel. Metallic layer 170 acts as a ground plane that is located at an intermediate point of thickness of the back skin 166 that depends on the precise shape of the radiating elements 140 employed, as well as other electrical considerations such as desired dielectric and loss tangent properties.

Figure 49:
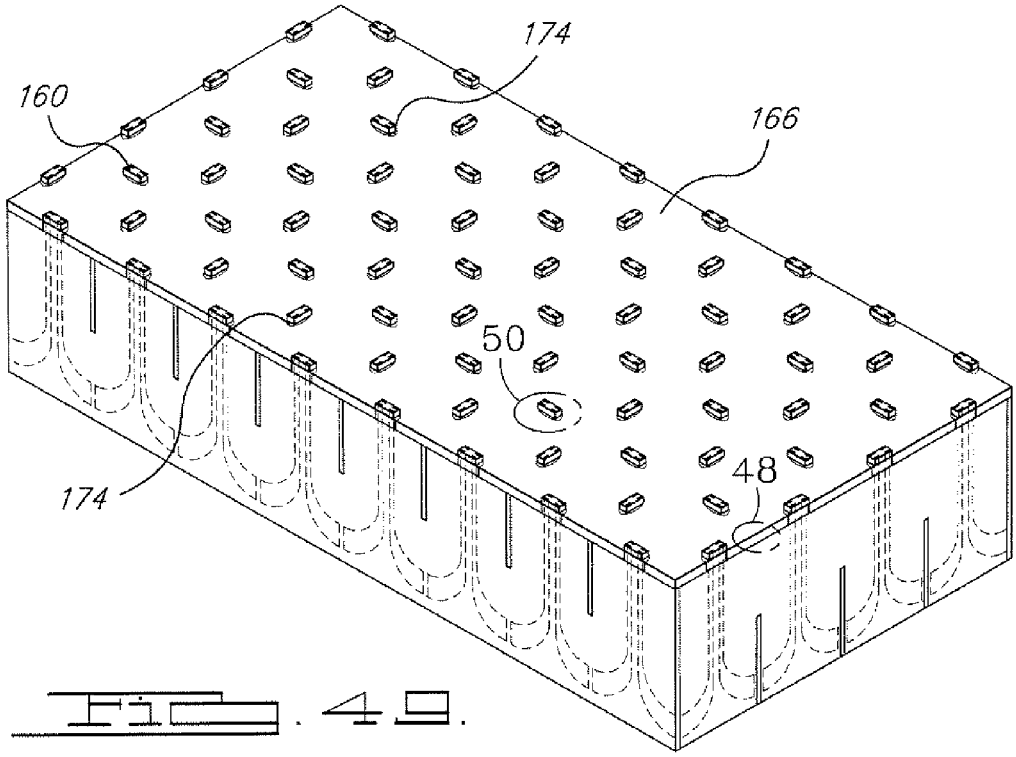
FIG. 49 is an illustration which illustrates an antenna aperture constructed using the back skin of FIG. 48.
Figure 50:
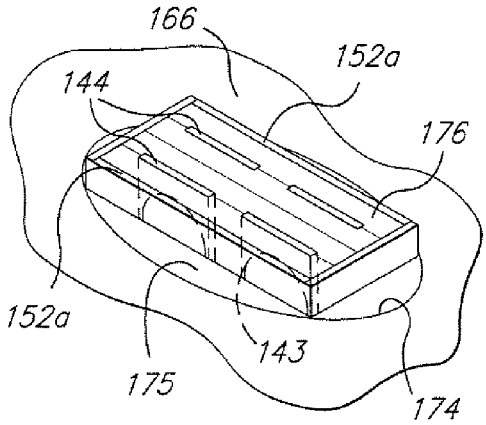
FIG. 50 is an illustration of a highly enlarged perspective view of one tooth projecting through the back skin of FIG. 49.

Referring to FIG. 49, after the wall portions 138*a* and 138*b* are assembled onto the back skin 166 and autoclave cured as described in connection with FIG. 29, each of the teeth 160 will project slightly outwardly through openings 174 in the back skin 166 as shown in FIG. 50. Each tooth 160 will further be surrounded by epoxy 175 that fills each opening 174.

Figure 51:
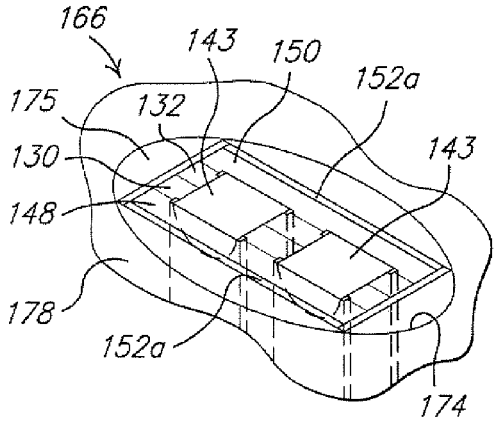
FIG. 51 is an illustration of an enlarged perspective view of the tooth of FIG. 50 after the tooth has been ground down flush with a surface of the back skin.

The tooth 160 is subsequently sanded so that its upper surface 176 is flush with an upper surface 178 of back skin 166, shown in FIG. 51. The resulting exposed surface is essentially a lower one-half of each metallic pin 143, which is electrically coupling each of the radiating elements 140 on opposite sides of the wall section 138*a* or 138*b*. Thus, metallic pins 143 essentially form electrical contact "pads" which readily enable electrical coupling of external components to the antenna aperture 10.

In mobile platform applications, the antenna aperture 10 also allows the integration of antenna or sensor capabilities without negatively impacting the aerodynamic performance of the mobile platform. The manufacturing method allows apertures of widely varying shapes and sizes to be manufactured as needed to suit specific applications.

Construction of Antenna Aperture Having Conformal Radome

Figure 52:
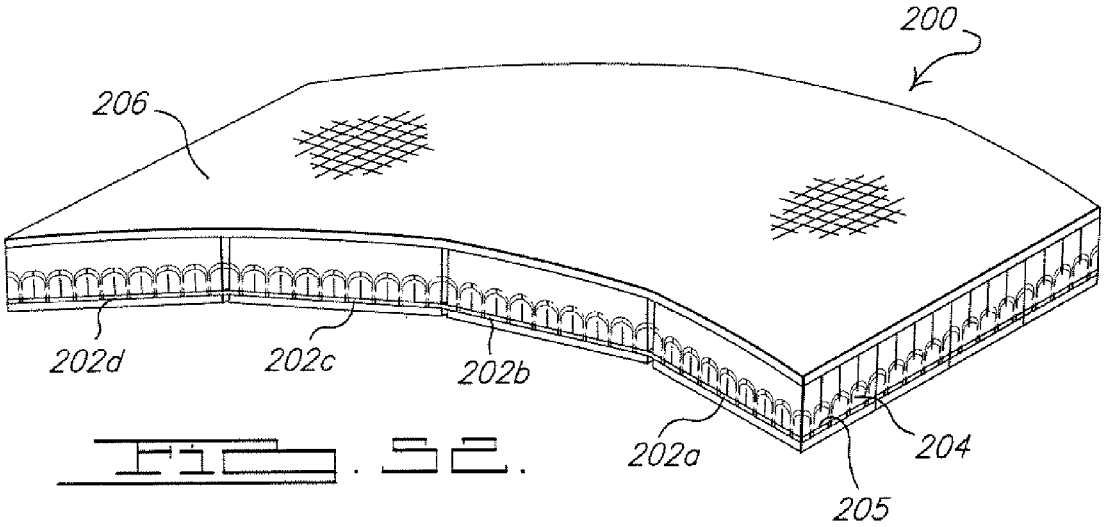
FIG. 52 is an illustration which illustrates a conformal, phased array antenna system in accordance with an alternative embodiments.

Referring to FIG. 52, a multi-faceted, conformal, phased-array antenna system 200 is shown in accordance with an alternative embodiment. Antenna system 200 generally includes a one-piece, continuous back skin 202 having a plurality of distinct, planar segments 202*a*, 202*b*, 202*c* and 202*d*. Four distinct antenna aperture sections 204*a*-204*d* are secured to a front surface 205 of each of the back skin segments 202*a*-202*d*. Antenna aperture sections 204*a*-204*d* essentially form honeycomb-like core sections for the system 200. A preferably one piece, continuous radome 206 covers all of the antenna aperture sections 204*a*-204*d*. Although four distinct aperture sections are employed, a greater or lesser plurality of aperture sections could be employed. The system 200 thus has a sandwich construction with a plurality of honeycomb-like core sections that is readily able to be integrated into non-linear composite structures.

The conformal antenna system 200 is able to provide a large number of densely packed radiating elements in accordance with a desired mold line to even better enable the antenna system 200 to be integrated into a non-linear structure of a mobile platform, such as a wing, fuselage, door, etc. of an aircraft, spacecraft, or other mobile platform. While the antenna system 200 is especially well suited for applications involving mobile platforms, the ability to manufacture the antenna system 200 with a desired curvature allows the antenna system to be implemented in a wide variety of other applications (possibly even involving on fixed structures) where a stealth, aerodynamics and/or load bearing capability are important considerations for the given application.

Figure 53:
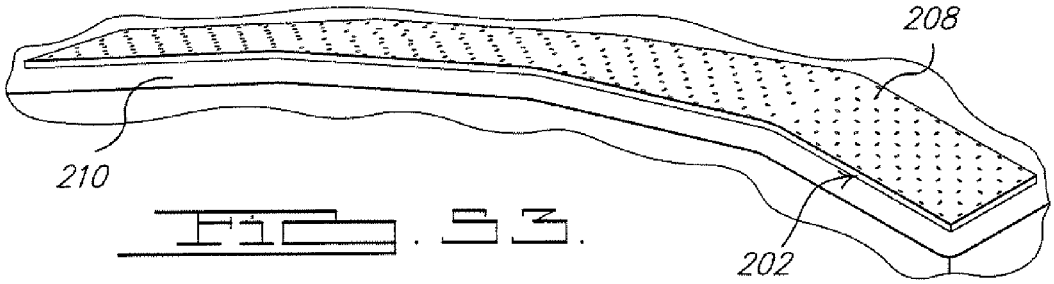
FIG. 53 is an illustration which illustrates a back skin of the antenna system of FIG. 52.

Referring to FIG. 53, the back skin 202 is shown in greater detail. The back skin 202 includes a plurality of openings 208 that will serve to connect with teeth of each of the antenna aperture sections 204*a*-204*d*. By segmenting the back skin 202 into a plurality of planar segments 202*a*-202*d*, printed circuit board assemblies can be easily attached to the back skin 202. The back skin 202 may be constructed from Astroquartz® fibers or in accordance with the construction of the back skin 166 shown in FIG. 48. The back skin 202 is pre-cured to form a rigid structure that is supported on a tool 210 that is shaped in accordance with the contour of the back skin 202.

Figure 54:
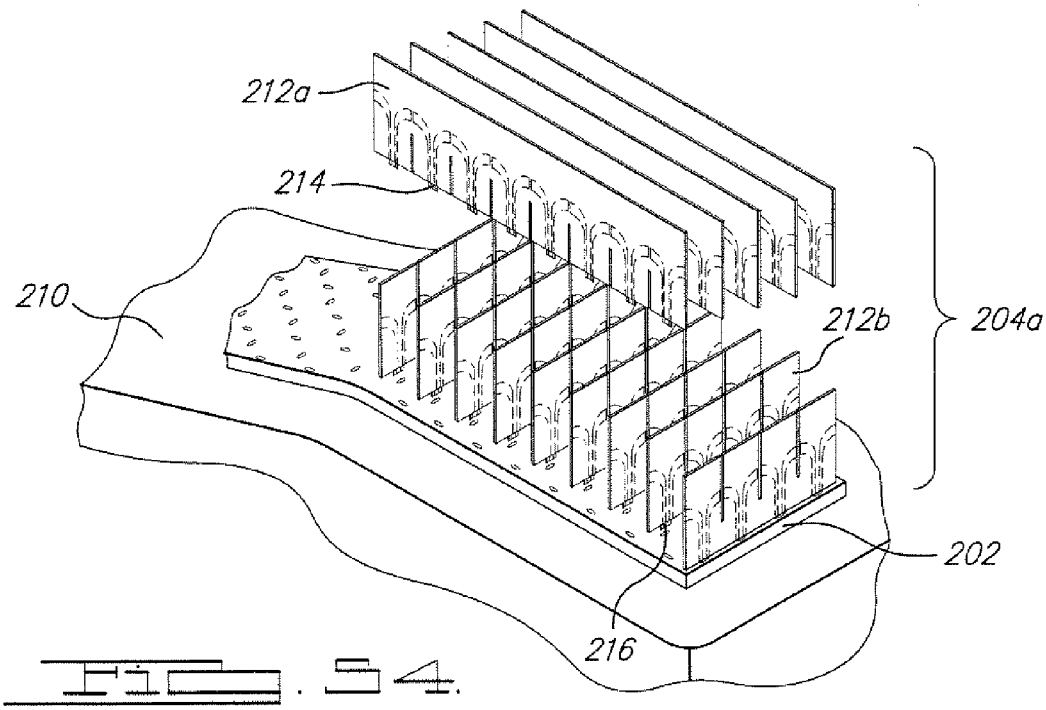
FIG. 54 is an illustration which illustrates the assembly of wall sections forming one particular antenna aperture section of the antenna system of FIG. 52.

Referring to FIG. 54, the construction of antenna aperture section 204*a* is illustrated. The sections 204*a*-204*d* could each be constructed with any of the construction techniques described in the present specification. Thus, the assembly of wall sections 212*a* and 212*b* onto the back skin 202 is intended merely to illustrate one suitable method of assembly. In this example, wall sections 212*a* and 212*b* are assembled using the construction techniques described in connection with FIGS. 31-37. Teeth 214 of wall sections 212*a* are inserted into holes 208 to secure the wall sections 212*a* to the back skin 202. Wall sections 212*b* having teeth 216 are then secured to the back skin 202 in interlocking fashion with wall sections 212*a*. During this process the entire back skin 202 is supported on the tool 210. Each of the antenna aperture sections 204*a*-204*d* are assembled in a manner shown in FIG. 54.

Figures 55, 56, 57:
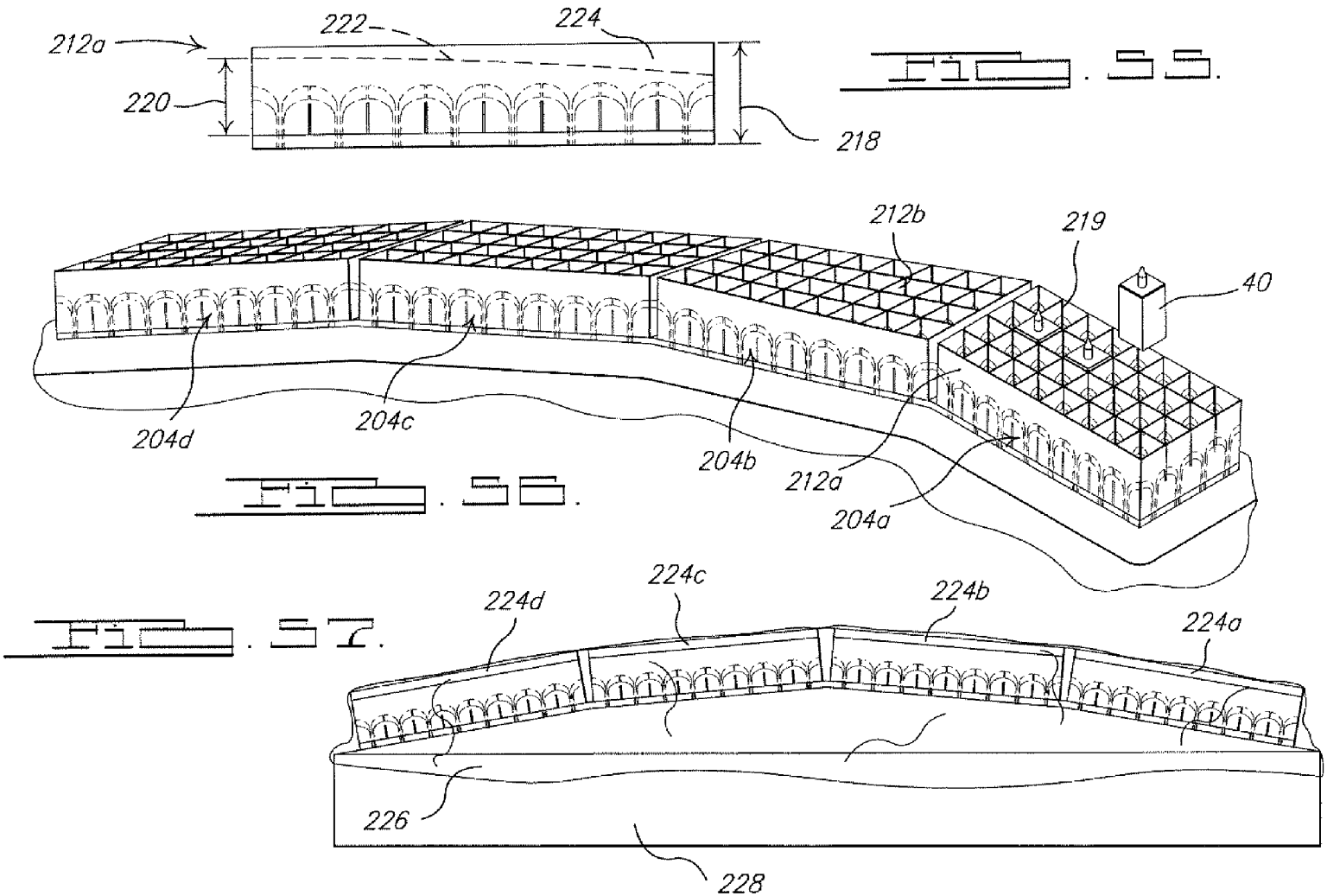
FIG. 55 is an illustration of a planar view of one wall section of the antenna system of FIG. 54 illustrating the area that will be removed in a subsequent manufacturing step to form a desired contour for the one wall section.
FIG. 56 is an illustration of a perspective view of each of the four antenna aperture sections assembled onto a common back skin with metallic blocks being inserted into each of the cells formed by the intersecting wall sections.
FIG. 57 is an illustration which illustrates the subassembly of FIG. 56 being vacuum compacted.

Referring to FIG. 55, one wall portion 212*a* is illustrated. Each of wall portions 212*a* of antenna module 204*a* have a height 218 that is at least as great, and preferably just slightly greater than, a height 220 of the highest point that the antenna aperture section 204*a* will have once the desired contour is formed for the antenna system 200. A portion of the desired contour is indicated by dashed line 222. Portion 224 above the dashed line 222 will be removed during a subsequent manufacturing operation, thus leaving only a portion of the wall section 212*a* lying beneath the dashed line 222. For simplicity in manufacturing, it is intended that the wall sections 212*a* and 212*b* of each of antenna modules 204*a*-204*d* will initially have the same overall height. However, depending upon the contour desired, it may be possible to form certain ones of the aperture sections 204*a*-204*d* with an overall height that is slightly different to reduce the amount of wasted material that will be incurred during subsequent machining of the wall portions to form the desired contour.

Referring to FIG. 56, once all of the aperture sections 204*a*-204*d* are assembled onto the back skin, then beads of adhesive 219 are placed at the intersecting areas of each of the wall portions 212*a* and 212*b*. Metallic blocks 40 are then inserted into the cells formed by the wall portions 212*a* and 212*b*.

Referring to FIG. 57, metal plates 224*a*-224*d* are then placed over each of the aperture sections 204*a*-204*d*. The entire assembly is covered with a vacuum bag 226 and rests on a suitably shaped tool 228. The assembly is vacuum compacted and then allowed to cure in an oven or autoclave.

Figure 58:
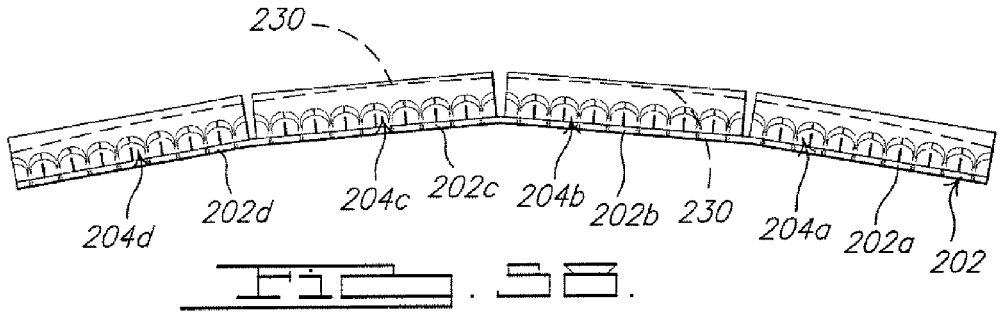
FIG. 58 is an illustration which illustrates the compacted and cured assembly of FIG. 56 with a dashed line indicating the contour that the antenna modules will be machined to meet.

In FIG. 58, the cured antenna aperture sections 204*a*-204*d* and back skin 202 are illustrated after the metallic blocks 40 have been removed. Dashed line 230 indicates a contour line that an upper edge surface of the aperture sections 204*a*-204*d* are then machined along to produce the desired contour.

Figure 59:
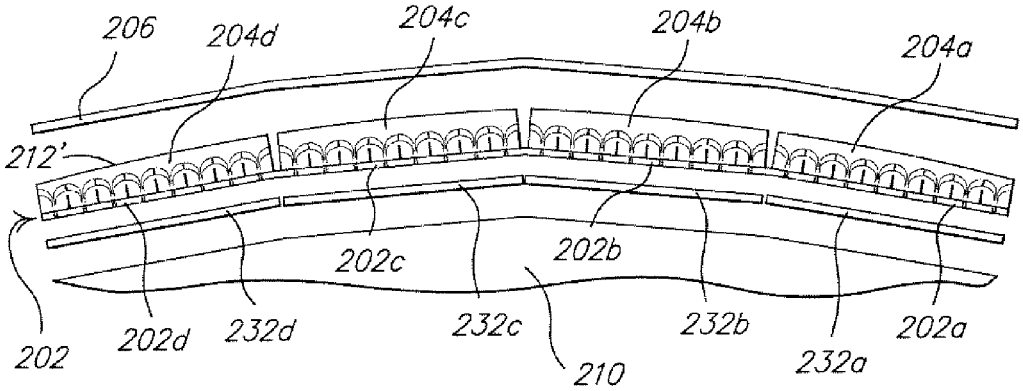
FIG. 59 is an illustration of an exploded perspective illustration of the plurality of antenna electronics circuit boards and the radome that are secured to the antenna aperture sections to form the conformal antenna system.

Referring to FIG. 59, the one piece, pre-cured radome 206 is then aligned over the aperture sections 204*a*-204*d* and bonded thereto during subsequent compaction and curing steps using tool 210. Surface 212' now has the contour that is needed to match the mold line of the structure into which the antenna system 200 will be installed.

Figure 60:
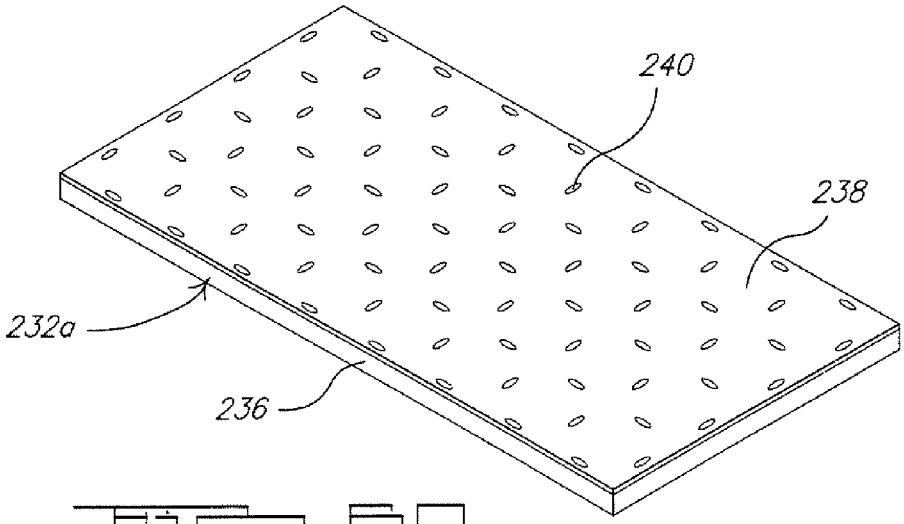
FIG. 60 is an illustration of an enlarged perspective view of an antenna electronics printed circuit board illustrating a section of adhesive film applied thereto with portions of the film being removed to form holes.
Figure 61:
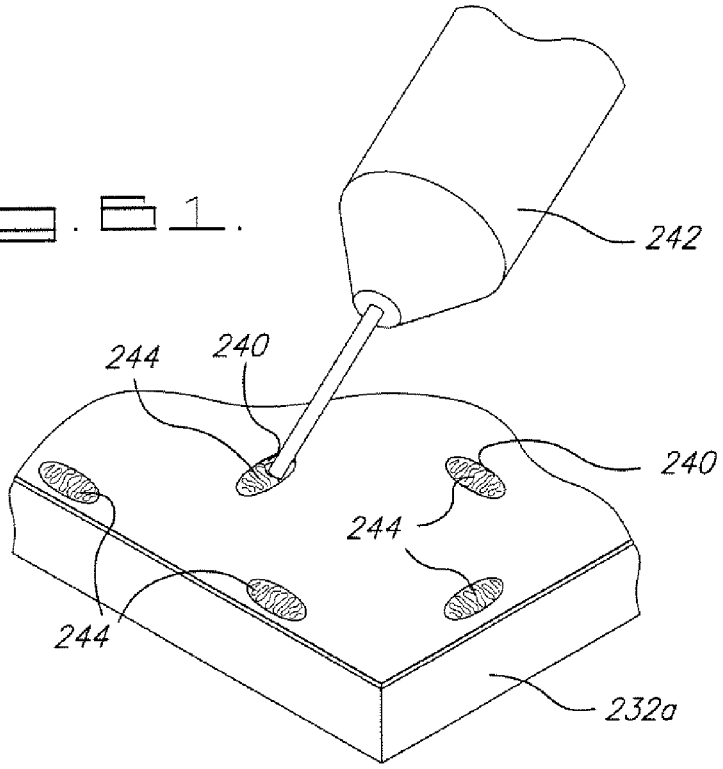
FIG. 61 is an illustration of a highly enlarged portion of one corner of the circuit board of FIG. 60 illustrating electrically conductive epoxy being placed in each of the holes in the adhesive film.

With reference to FIGS. 60 and 61, the construction of one antenna electronics circuit board 232*a* is shown in greater detail. In FIG. 60, circuit board 232*a* includes a substrate 236 upon which an adhesive film 238 is applied. The adhesive film 238 may comprise one ply of 0.0025" (0.0635 mm) thick, Structural™ bonding tape available from 3M Corp., or possibly even a plurality of beads of suitable epoxy. If adhesive film 238 is employed, a plurality of circular or elliptical openings 240 are produced by removing portions of the adhesive film 238. The openings 240 are preferably formed by punching out an elliptical or circular portion after the adhesive film 238 has been applied to the substrate 236. The openings 240 are aligned with the teeth 214 and 216 of each of the wall sections 212*a* and 212*b*. The thickness of adhesive film 238 may vary but is preferably about 0.0025 inch (0.0635 mm).

In FIG. 61, a syringe 242 or other suitable tool is used to fill the holes 240 with an electrically conductive epoxy 244. The electrically conductive epoxy 244 provides an electrical coupling between the teeth 214 and 216 on each of the wall sections 212*a* and 212*b* and circuit traces (not shown) on circuit board 232*a*.

The bonded and cured assembly of FIG. 59 is then bonded to the circuit boards 232*a*-232*d*. A suitable tooling jig with alignment pins is used to precisely locate the circuit boards 232*a*-232*d* with the teeth 214 and 26 of each of the aperture sections 204*a*-204*d*. The assembled components are placed on a heated press. Curing is performed at a temperature of preferably about 225° F.-250° F. (107° C.-131° C.) at a pressure of about 20 psi minimum for about 90 minutes.

Figure 62:
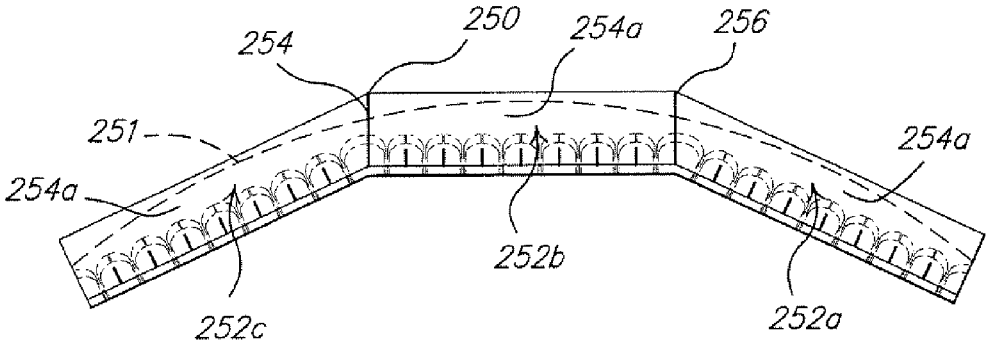
FIG. 62 is an illustration of an end view of an alternative preferred embodiment of the antenna system in which wall portions that are used to form each of the antenna aperture sections are shaped to minimize the areas of the gaps between adjacent edges of the modules.

Referring to FIG. 62, depending upon the degree of curvature that the contour at the antenna system 200 needs to meet, the small areas inbetween adjacent antenna modules 204*a*-204*d* may be too large for the load bearing requirements that the antenna system 200 is required to meet. In this event, the wall portions 212*a* and 212*b* can be pre-formed with a desired shape intended to reduce the size of the gaps formed between the aperture sections 204*a*-204*d*. An example of this is shown in FIG. 62 in which three aperture sections 252*a*, 252*b* and 252*c* will be required to form a more significant curvature than illustrated in FIG. 52. In this instance, wall sections 254*a* of each aperture section 252*a*-252*c* are formed such that the edge that is adjacent center module 252*b* significantly reduces the gaps 256 that are present on opposite sides of antenna module 252. In practice, the wall sections 212*a* and/or 212*b* can also be formed with dissimilar edge contours to reduce the area of the gaps that would otherwise be present between the edges of adjacent aperture sections 204*a*-204*d*.

By forming a plurality of distinct aperture sections, modular antenna systems of widely varying scales and shapes can be constructed to meet the needs of specific applications.

Further Alternative Construction of Antenna Aperture

Figure 63:
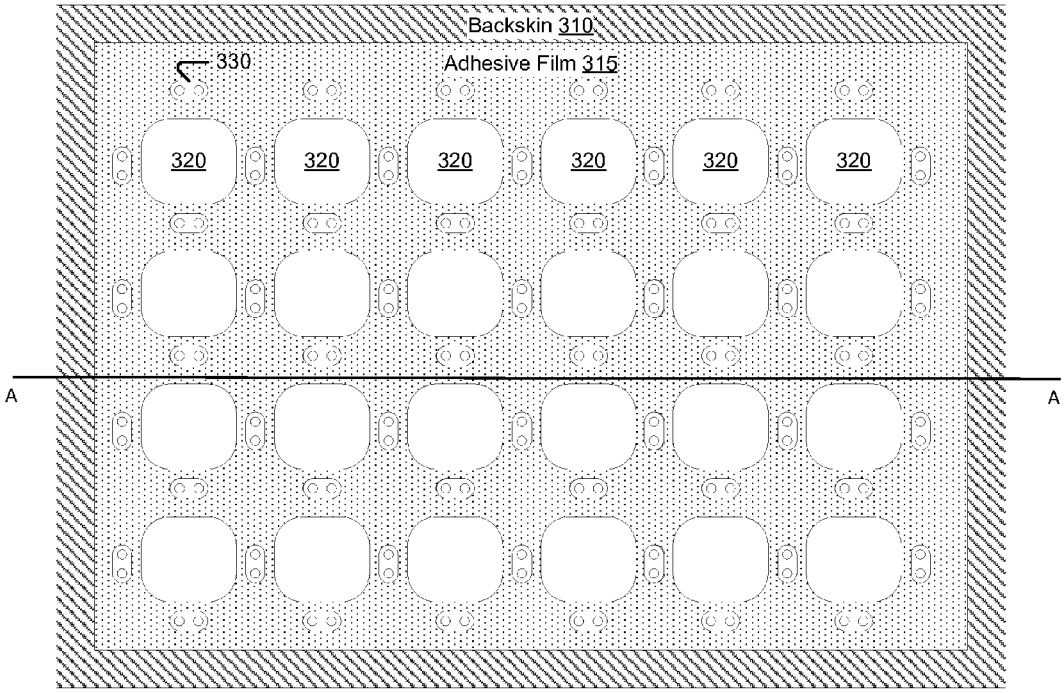
FIG. 63 is an illustration of a top, planar illustration of a back skin and an adhesive assembly, according to embodiments.
Figure 64:
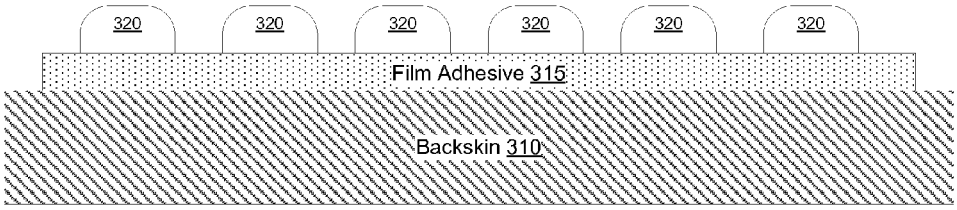
FIG. 64 is an illustration of a cross-sectional planar illustration of a back skin and an adhesive assembly taken along a longitudinal axis A-A as illustrated in FIG. 63, according to embodiments.
Figure 65:
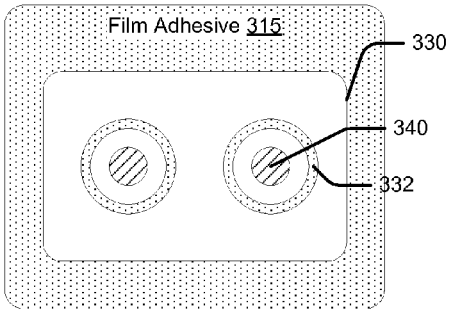
FIG. 65 is an illustration of a close-up illustration of a section a rebate in the adhesive assembly covering the back skin.

Further embodiments of antenna apertures and methods of forming the same will be explained with reference to FIGS. 63-70. In some embodiments construction of an antenna aperture is enhanced by the use of novel adhesive components and tools, and associated construction techniques. Referring briefly to FIGS. 63-65, in one embodiment construction of an antenna aperture is enhanced by the use of at least one film adhesive assembly comprising a layer of adhesive film 315 and a plurality of adhesive packs 320. In one embodiment the adhesive packs 320 are spaced on the adhesive film 315 in a manner that corresponds to the dimensions of the individual cells of the antenna aperture 10. The adhesive packs 320 may be formed from an outer layer that comprises an adhesive film (which may be contiguous with adhesive film 315) or a polymeric coating, and may comprise an adhesive paste. The adhesive film 315 may be mounted on a back skin 310, which may correspond to the back skin 16 depicted in FIG. 1.

Adhesive film 315 may further comprise a plurality of rebates 330 formed in a predetermined pattern. In one embodiment, the predetermine pattern corresponds to a pattern of antenna feed elements on an electronics board 232 (FIGS. 59-62) which may be mounted to the back skin 315. In such embodiments, back skin 310 may comprise corresponding via holes to allow for electrical interconnection between circuit elements 340 on the electronics board 232 and electrical components 14 on the antenna aperture 10.

In the embodiment depicted in FIG. 63 the adhesive film 315 comprises a matrix of evenly spaced adhesive packs 320, each of which is surrounded by four rebates 330. This configuration permits the radiating elements 14 (FIG. 6) on each of the four sides of each antenna aperture 10 to establish electrical contact with an electronics board 232. One skilled in the art will recognize that other configurations may be used.

FIG. 65 is a close-up illustration of a section of a rebate 330 in the adhesive assembly covering the backskin 315. Referring to FIG. 65, in some embodiments one or more of the rebates may be formed by using a laser to ablate sections of the film adhesive 315 to define the rebate 330. One skilled in the art will recognize that other removal operations may be used. In some embodiments a small dam 332 surrounding a connection point which provides an electrical connection to an electrical feed (e.g., an RF feed) 340 on the electronics board 232 may be formed on the electronics board 232. In some embodiments the dam 332 may be formed by a liquid photoimaging (LPI) process or the like. Heat from the laser cures the adhesive around the rebate, which acts as a dam 332 on the adhesive.

Figure 66:
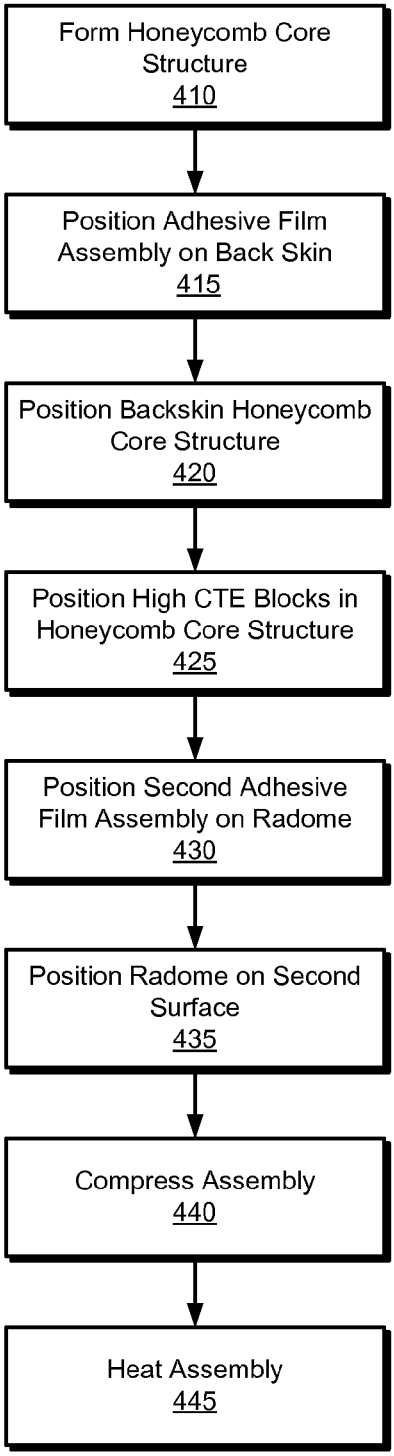
FIG. 66 is an illustration of a flowchart illustrating operations in a method to make an antenna aperture, according to embodiments.

In some embodiments construction of an antenna aperture 10 may be enhanced by using an adhesive film assembly like that depicted in FIGS. 63-65. FIG. 66 is a flowchart illustrating operations in a method to make an antenna aperture 10, according to embodiments. Referring to FIG. 66, at operation 410 a honeycomb core structure of the antenna aperture 10 is formed using one or more of the techniques described herein. As used herein, the term honeycomb core structure refers to the assembly formed by the respective wall sections 12. By way of example, the sub assembly 76 depicted in FIG. 24 may be considered a honeycomb core structure, as used herein. Further, while the embodiments described herein illustrate a honeycomb core structure 76 which is formed from a plurality of wall structures 14 disposed substantially at right angles, it will be appreciated that other configurations may be used.

At operation 415 a first adhesive film 315 is positioned on a back skin 310. As described above, in some embodiments the rebates 330 in the adhesive film 315 may align with vias on the backskin 310. At operation 420 the back skin 310 is positioned on the honeycomb core structure 76. In one embodiment the lower surfaces of the wall sections 12 define a first surface and the upper surfaces of the wall sections 12 define a second surface. More accurately, the respective upper and lower surfaces of the wall sections 12 define a plurality of surfaces. These plurality of surfaces may be referred to collectively herein as a surface. Thus, in one embodiment operation 420 may be implemented by positioning the back skin 310 on the lower surface of the honeycomb core structure 76 such that the adhesive packs 320 each reside in one of the cells defined by the wall structures 12.

At operation 425 the honeycomb core structure 76 is filled with blocks 40 as described above with reference to FIG. 34. In one embodiment, the blocks 40 may be formed from a material having a relatively high coefficient of thermal expansion (CTE), e.g., without limitation a Teflon material or the like. Using blocks 40 constructed from a high CTE material, permits the blocks 40 to be sufficiently undersized to facilitate easy insertion and extraction from the assembly 76. The design and high CTE of the tooling blocks 40 reduces the amount of adhesive on the cell walls and allows for the adhesive 320 to ride up and create fillets along the intersections of the cell walls and core to backskin.

At operation 430 a second adhesive film 315 is positioned on a radome 112, and at operation 435 the radome 112 is positioned on the second surface of the honeycomb core structure 76 defined by the upper surfaces of wall sections 12. In some embodiments the second adhesive film 315 is laser ablated to allow for the adhesive to be matched and positioned on the assembly 76 and create fillets between the radome and core.

At operation 440 the entire assembly is compressed and at operation 445 the assembly is heated. Operations 440 and 445 may be performed as described above with reference to FIG.

35, e.g., by placing the assembly in a vacuum bag 70 and curing the assembly in an autoclave. When the assembly is heated in the autoclave the pressure and temperature forces the adhesive in the adhesive packs 320 to cover the wall sections 12 of the cells 10, thereby forming a structural fillet. In some embodiments the structural fillet is between the intersecting cell walls and also along the backskin to the cell wall.

Figure 67:
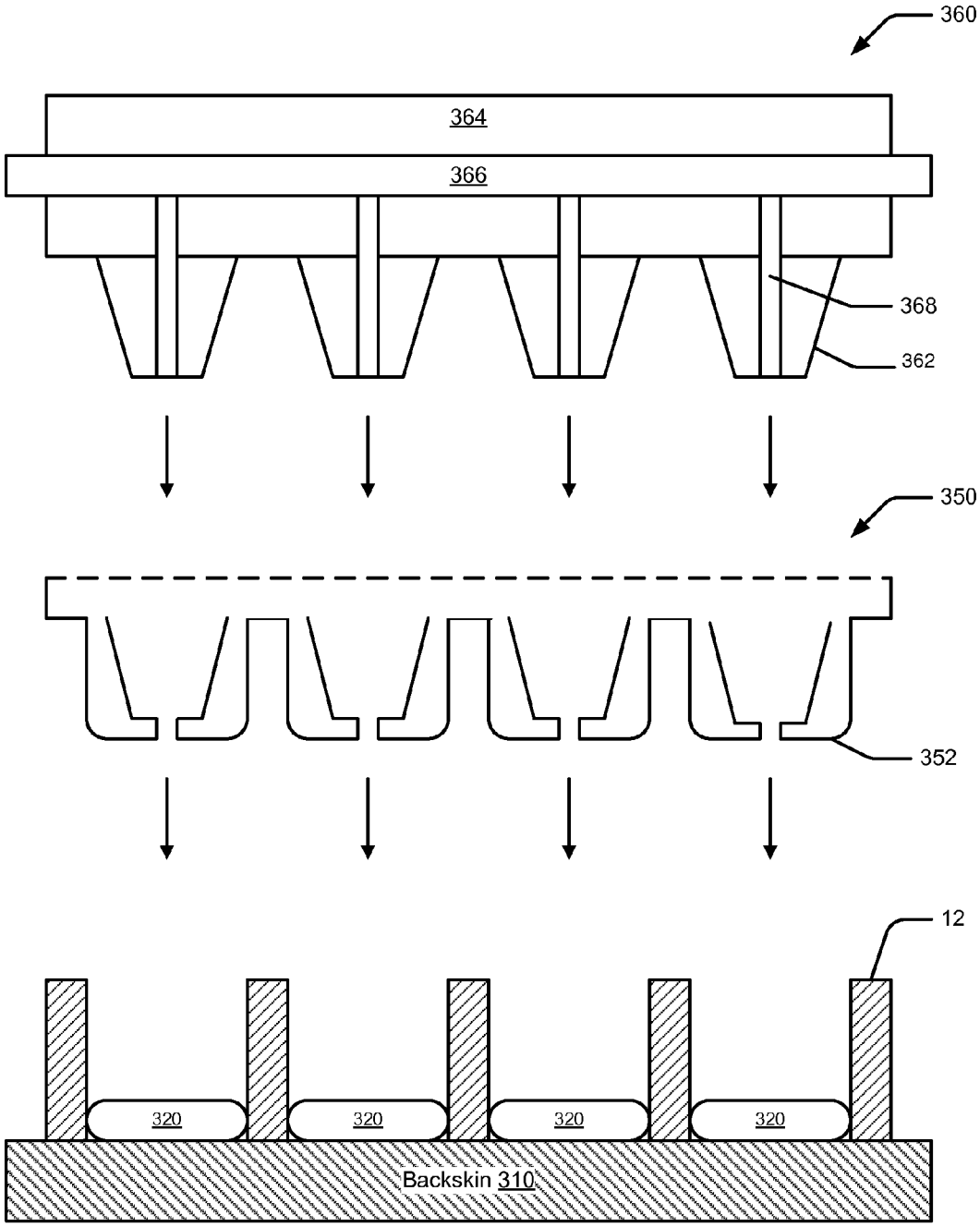
FIGS. 67-69 are illustrations of a cross-sectional views of a tooling assembly and an antenna assembly, according to embodiments.
Figure 68:
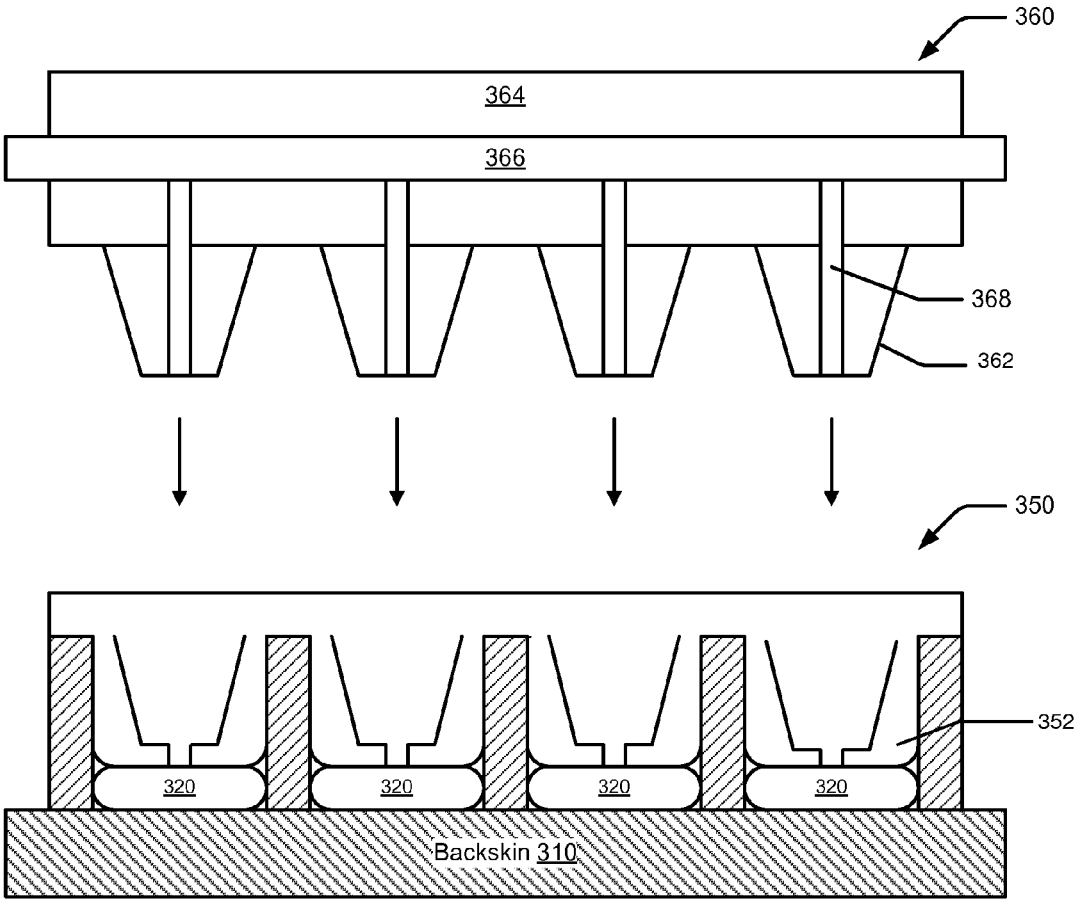
Figure 69:
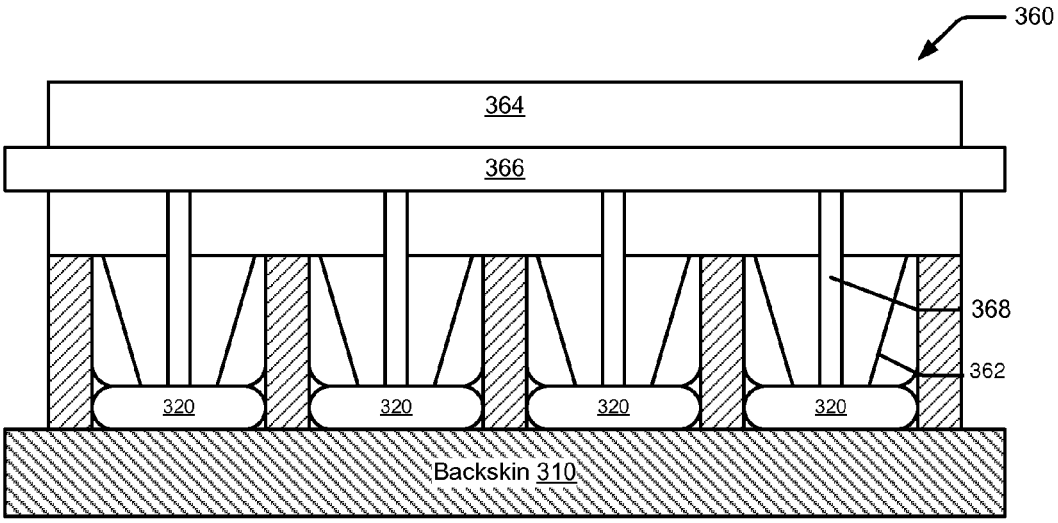

In an alternate embodiment the tool blocks 40 may be replaced with a multi-part, honeycomb shaped tool 350 that may be inserted into the cells of the honeycomb structure 76 during the curing process, then removed to allow placement of the radome 112 on the assembly. FIGS. 67-69 are cross-sectional views of a tooling assembly and an antenna assembly, according to embodiments. Referring to FIGS. 67-69, in one embodiment a first honeycomb tool 350 comprises a plurality of plugs 352 which are dimensioned to fit in the respective cells defined by the wall sections 12 of the honeycomb core structure 76. In one embodiment the plugs 352 may be formed from a high CTE material, e.g., a silicone rubber material or the like.

A second honeycomb tool 360 further includes a plurality of plugs 362 dimensioned to fit in the plugs 352 of the first tool 350. The tool 360 may be formed from a substantially rigid material having a relatively low CTE, e.g., aluminum, plastic or the like. In some embodiments, tool 360 comprises a top block 364. One or more fluid tubes 366 extend through top block 364 and one or more fluid tubes 368 extend through the plugs 362.

Figure 70:
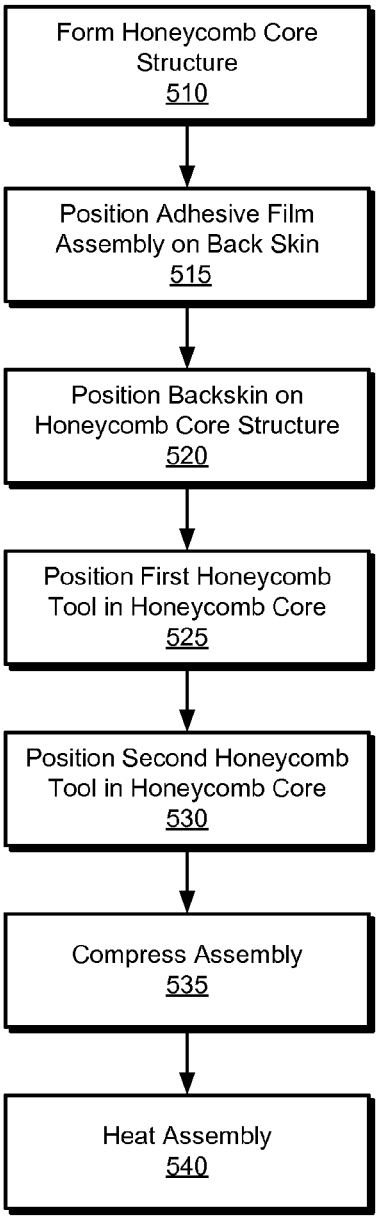
FIG. 70 is an illustration of a flowchart illustrating operations in a method to make an antenna aperture, according to embodiments.

FIG. 70 is a flowchart illustrating operations in a method to make an antenna aperture 10 using the tool assembly depicted in FIGS. 67-69. Referring to FIGS. 67-70, at operation 510, a honeycomb core structure 76 of the antenna aperture 10 is formed using one or more of the techniques described herein. As used herein, the term honeycomb core structure 76 refers to the assembly formed by the respective wall sections 12. By way of example, the sub assembly 76 depicted in FIG. 24 may be considered a honeycomb core structure 76, as used herein. Further, while the embodiments described herein illustrate a honeycomb core structure 76 which is formed from a plurality of wall structures disposed substantially at right angles, it will be appreciated that other configurations may be used.

At operation 515, a first adhesive film 315 is positioned on a back skin 310. As described above, in some embodiments the rebates 330 in the adhesive film 315 may align with vias on the back skin 310. At operation 520, the back skin 310 is positioned on the honeycomb core structure. In one embodiment, the lower surfaces of the wall sections 12 define a first surface and the upper surfaces of the wall sections 12 define a second surface. More accurately, the respective upper and lower surfaces of the wall sections 12 define a plurality of surfaces. These plurality of surfaces may be referred to collectively herein as a surface. Thus, in one embodiment, operation 520 may be implemented by positioning the back skin 310 on the lower surface of the honeycomb core structure 76 such that the adhesive packs 320 each reside in one of the cells defined by the wall structures 12.

At operation 525, the first honeycomb tool 350 is positioned in the honeycomb core structure 76. As illustrated in FIG. 68, the first honeycomb tool 350 is positioned such that the plugs 352 are in contact with adhesive packs 350. At operation 530, the second honeycomb tool 360 is positioned such that the plugs 362 of the second honeycomb tool 360 fit within the plugs 352 of the first honeycomb tool 350 (FIG. 69).

The resulting assembly depicted in FIG. 69 may then be compressed (operation 535) and heated (operation 540) as described above to form an antenna aperture assembly like the assembly 114 depicted in FIG. 37. When the assembly 114 is finished bonding, the tools 350 and 360 may be removed from the honeycomb structure 76. In one embodiment, a pressurized fluid (e.g., air or the like) may be delivered through the fluid tubes 366, 368 to facilitate removal of the tools 350, 360 from the assembly. Subsequently, a radome 112 (FIG. 36) may be secured to the upper surfaces of the wall sections 12 of the honeycomb structure 76, as described above.

In an alternate embodiment, adhesive may be delivered under pressure through fluid tubes 366, 368. In such embodiments, the adhesive packs 320 may be omitted from the film assembly disposed on the back skin 310.

Figure 71:
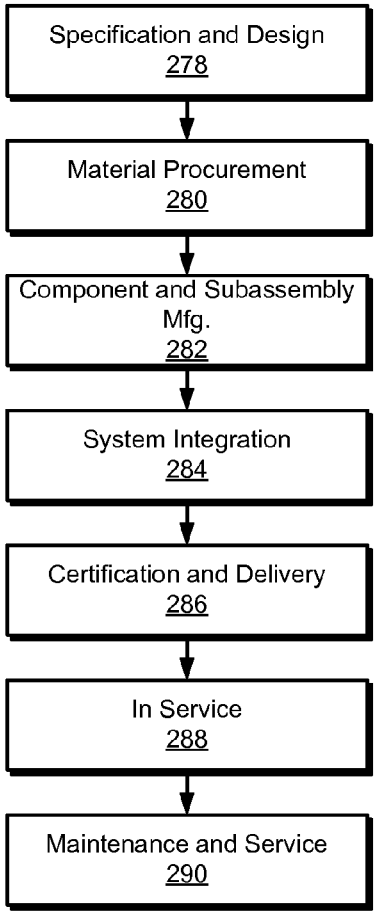
FIG. 71 is a flow diagram of an aircraft production and service methodology, according to embodiments.
Figure 72:
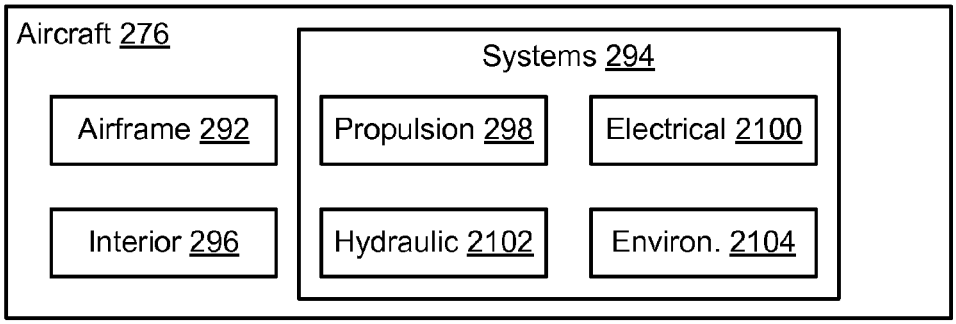
FIG. 72 is a block diagram of an aircraft, according to embodiments.

Referring next to FIGS. 71 and 72, embodiments of the disclosure may be used in the context of an aircraft manufacturing and service method as shown in FIG. 71 and an aircraft 276 as shown in FIG. 72. Aircraft applications of the disclosed embodiments may include, for example, without limitation, composite stiffened members such as fuselage skins, wing skins, control surfaces, hatches, floor panels, door panels, access panels and empennages, to name a few. These materials may also find use in applications in gas turbine/rocket engine components such as compressor blades and disks, and gas turbine blades and disks, and ramjet/scramjet engine components. During pre-production, exemplary method may include specification and design 278 of the aircraft 276 and material procurement 280. During production, component and subassembly manufacturing 282 and system integration 284 of the aircraft 276 takes place. Thereafter, the aircraft 276 may go through certification and delivery 286 in order to be placed in service 288. While in service by a customer, the aircraft 276 is scheduled for routine maintenance and service 290 (which may also include modification, reconfiguration, refurbishment, and so on).

Each of the processes of method may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 71, the aircraft 276 produced by exemplary method may include an airframe 292 with a plurality of systems 294 and an interior 296. Examples of high-level systems 294 include one or more of a propulsion system 298, an electrical system 2100, a hydraulic system 2102, and an environmental system 2104. Any number of other systems may be included. Although an aerospace example is shown, the principles of the invention may be applied to other industries, such as the automotive industry.

The apparatus embodied herein may be employed during any one or more of the stages of the production and service method 74. For example, components or subassemblies corresponding to production process 82 may be fabricated or manufactured in a manner similar to components or subassemblies produced while the aircraft 76 is in service. Also, one or more apparatus embodiments may be utilized during the production stages 82 and 84, for example, by substantially expediting assembly of or reducing the cost of an aircraft 76. Similarly, one or more apparatus embodiments may be utilized while the aircraft 76 is in service, for example and without limitation, to maintenance and service 90.

Thus, described herein are novel methods to form a load bearing antenna aperture and novel structures resulting from such methods. The various methods provide an antenna aperture having a honeycomb-like core sandwiched between a pair of panels that forms a construction enabling the aperture to be readily integrated into composite structures to form a load bearing portion of the composite structure. The antenna apertures do not add significant weight beyond what would otherwise be present with conventional honeycomb-like core, sandwich-like construction techniques, and yet provides an antenna capability.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

What is claimed is:

1. A method to form a load bearing antenna aperture, comprising:

forming a honeycomb core structure having a plurality of wall sections, the wall sections including electromagnetic radiating elements, upper surfaces and lower surfaces the lower surfaces defines a first surface and the upper surfaces define a second surface;

positioning a back skin to the first surface of the honeycomb core structure with an adhesive layer which comprises:

a layer of adhesive film; and a paste adhesive disposed on the layer of adhesive film;

positioning an antenna electronics board to at least a portion of the back skin; and positioning a radome to the second surface of the honeycomb core structure to define a load bearing antenna aperture.

2. The method of claim 1, wherein:

the antenna electronics board comprises a plurality of antenna feed elements arranged in a predetermined pattern; and the layer of adhesive film comprises a plurality of rebates formed in a predetermined pattern corresponding to the predetermined pattern of antenna feed elements.

3. The method of claim 2, wherein the antenna electronics board comprises a plurality of adhesive dam structures in a predetermined pattern corresponding to the predetermined pattern of antenna feed elements.

4. The method of claim 1, further comprising positioning a second adhesive layer on the second surface.

5. The method of claim 1, further comprising initiating a bonding cycle which comprises:

compressing the load bearing antenna aperture; and heating the load bearing antenna structure to bond adhesive.

6. The method of claim 5 wherein, prior to the bonding cycle, the honeycomb structure is loaded with a plurality of tooling blocks formed from a solid material having a high coefficient of thermal expansion.

7. The method of claim 5 wherein, prior to the bonding cycle:

a first honeycomb tool is positioned in the honeycomb core structure, wherein the first honeycomb tool is formed from a solid material having a high coefficient of thermal expansion; and a second honeycomb tool is positioned in the first honeycomb tool, wherein the second honeycomb tool is formed from a solid material having a low coefficient of thermal expansion.

8. The method of claim 7, wherein the second honeycomb tool comprises a plurality of air passages such that, after the bonding cycle, the second tool may be removed from the first tool by injecting air into the air passages.

9. The method of claim 5, wherein, during the bonding cycle, the paste adhesive flows onto the plurality of wall sections to form a structural fillet.

10. A method to form a load bearing antenna aperture, comprising:

forming a honeycomb core structure having a plurality of wall sections, the wall sections including electromagnetic radiating elements, wherein lower surfaces of the wall sections defines a first surface and upper surfaces of the wall sections define a second surface;

positioning an adhesive layer on at least one of the first surface or the second surface;

positioning a back skin to the first surface of the honeycomb core structure;

positioning a first honeycomb tool into the honeycomb core structure;

positioning a second honeycomb tool into the first honeycomb tool to form an antenna aperture assembly; and curing the antenna aperture assembly;

securing an antenna electronics board to at least a portion of the back skin; and securing a radome to the second surface of the honeycomb core structure to define a load bearing antenna aperture.

11. The method of claim 10, wherein:

the antenna electronics board comprises a plurality of antenna feed elements arranged in a predetermined pattern; and the first layer of adhesive film comprises a plurality of rebates formed in a predetermined pattern corresponding to the predetermined pattern of antenna feed elements.

12. The method of claim 11, wherein the antenna electronics board comprises a plurality of adhesive dam structures in a predetermined pattern corresponding to the predetermined pattern of antenna feed elements.

13. The method of claim 10, further comprising positioning a second adhesive layer on the second surface.

14. The method of claim 10, further comprising initiating a bonding cycle which comprises:

compressing the load bearing antenna aperture; and heating the load bearing antenna structure to bond adhesive.

15. The method of claim 14, wherein, during the bonding cycle, the paste adhesive flows onto the plurality of wall sections to form a structural fillet.

* * * * *